US006291943B1

(12) United States Patent
Murai et al.

(10) Patent No.: US 6,291,943 B1
(45) Date of Patent: Sep. 18, 2001

(54) GAS DISCHARGE PANEL AND GAS LIGHT-EMITTING DEVICE

(75) Inventors: Ryuichi Murai; Akira Shiokawa, both of Osaka; Hiroyosi Tanaka, Kyoto; Yoshiki Sasaki; Masaki Aoki, both of Osaka; Masatoshi Kudoh, Kumamoto; Yuusuke Takada; Hiroyuki Kado, both of Osaka, all of (JP)

(73) Assignee: Matsushita Electric Industrial Co., Ltd., Osaka-fu (JP)

( * ) Notice: Subject to any disclaimer, the term of this patent is extended or adjusted under 35 U.S.C. 154(b) by 0 days.

(21) Appl. No.: 09/254,886

(22) PCT Filed: Aug. 14, 1998

(86) PCT No.: PCT/JP98/03625

§ 371 Date: Jun. 4, 1999

§ 102(e) Date: Jun. 4, 1999

(87) PCT Pub. No.: WO99/09578

PCT Pub. Date: Feb. 25, 1999

(30) Foreign Application Priority Data

Aug. 14, 1997 (JP) ..... 9-219629
Oct. 15, 1997 (JP) ..... 9-281721

(51) Int. Cl.[7] ..... H01J 13/12
(52) U.S. Cl. ..... 315/188; 315/169.3
(58) Field of Search ..... 315/169.3; 313/493, 313/581, 486, 220, 188, 223, 484; 345/60

(56) References Cited

U.S. PATENT DOCUMENTS 3,886,393 * 5/1975 Hinson ..... 313/223
3,896,327 * 7/1975 Schermerhorn ..... 313/220
3,904,915 * 9/1975 Hinson ..... 313/484
3,916,245 * 10/1975 Dorf et al. ..... 313/486
3,925,697 * 12/1975 Fein et al. ..... 313/223
4,048,533 * 9/1977 Hinson et al. ..... 313/188
5,770,921 * 6/1998 Aoki et al. ..... 313/581
5,793,158 * 8/1998 Wedding, Sr. ..... 313/493
5,828,356 * 10/1998 Stoller ..... 345/60
6,005,343 * 12/1999 Rakhimov et al. ..... 313/493
6,013,986 * 1/2000 Knall et al. ..... 315/169.3

* cited by examiner

*Primary Examiner*—Don Wong
*Assistant Examiner*—Chuc Trand
(74) *Attorney, Agent, or Firm*—Price and Gess

(57) ABSTRACT

The object of the present invention is to provide a gas discharge panel, where the conversion efficiency of discharge energy into visible rays and the panel brightness are improved, with the color purity being improved as far as possible. To achieve this object, in a gas discharge panel, the pressure of discharge gas is set in a range of 800–4000 Torr, that is higher than a conventional gas pressure. Also, a rare gas mixture including helium, neon, xenon, and argon is used as discharge gas charged into discharge spaces, instead of conventional discharge gas. Here, it is preferable that the proportion of Xe is set to 5% by volume or less, that of Ar 0.5% by volume or less, and that of He under 55% by volume. With this rare gas mixture, the light-emission efficiency is improved, with the firing voltage being suppressed. Furthermore, display electrodes and address electrodes are arranged on the surface of either of a front cover plate and a back plate, with a dielectric layer existing between the display electrodes and the address electrodes. With this construction, addressing is performed with a relatively low voltage even if the gas pressure is high.

45 Claims, 14 Drawing Sheets

CURRENT WAVEFORM OF TRANSITION GLOW AND ARC
(Craggs et al. 1970)

ENERGY LEVEL AND REACTIVE PROCESS OF Xe

EXCITATION SPECTRUM OF RED PHOSPHOR

EXCITATION SPECTRUM OF GREEN PHOSPHOR

EXCITATION SPECTRUM OF BLUE PHOSPHOR

| SYMBOL | GAS TYPE | PANEL BRIGHTNESS(cd/m$^2$) |
|---|---|---|
| ▲ | He-Xe(5%) | 475 |
| ◆ | Ne-Xe(5%) | 269 |
| × | Ne-Xe(10%) | 297 |
| ■ | Ne-Xe(5%)-Ar(0.5%) | 252 |
| ○ | Ne-Xe(1%)-Ar(0.1%) | 238 |
| * | He-Ne(35%)-Xe(5%) | 580 |

| SYMBOL | GAS TYPE | PANEL BRIGHTNESS ($cd/m^2$) |
|---|---|---|
| ◆ | He(50)−Ne(48)−Xe(2) | 547 |
| ■ | He(50)−Ne(48)−Xe(2)−Ar(0.1) | 566 |
| ▲ | He(30)−Ne(68)−Xe(2) | 518 |
| ● | He(30)−Ne(67.9)−Xe(2)−Ar(0.1) | 532 |

GAS DISCHARGE PANEL AND GAS LIGHT-EMITTING DEVICE

FIELD OF THE INVENTION

This invention relates to a gas discharge tube, such as a gas discharge panel and a gas light-emission device, and in particular to a high-definition plasma display panel.

BACKGROUND OF THE INVENTION

Recently, as expectations for high-quality and large-screen TVs such as high-definition TVs have increased, displays suitable for such TVs, such as CRT, Liquid Crystal Display (LCD), and Plasma Display Panel (PDP), have been developed.

CRTs have been widely used as TV displays and excel in resolution and picture quality. However, the depth and weight increase as the screen size increases. Therefore, CRTs are not suitable for large screens exceeding 40 inch in size. LCDs have high performance such as low power consumption and low driving voltage. However, producing a large LCD is technically difficult and the viewing angles of LCDs are limited.

On the other hand, it is possible to produce a large-screen PDP with a short depth, and 50-inch PDP products have already been developed.

PDPs are broadly divided into two types: Direct Current type (DC type) and Alternating Current type (AC type). Currently, PDPs are mainly AC type since these are suitable for large screens.

An ordinary AC PDP includes a front cover plate and a back plate, where partition walls called barrier ribs are inserted between the front cover plate and the back plate to form discharge spaces. Discharge gas is charged into the discharge spaces. The front cover plate with display electrodes thereon is covered with a dielectric glass layer made of lead glass. The back plate is provided with address electrodes, the barrier ribs, and phosphor layers made of red, green, and blue ultraviolet excitation phosphors.

The discharge gas is ordinarily helium (He)-xenon (Xe) or neon (Ne)-xenon (Xe) mixture gas. The gas pressure is set in a range of 500 to 600 Torr to keep firing voltage at 250V or less (see M. Nobrio, T. Yoshioka, Y. Sano, K. Nunomura, SID94' Digest 727–730 1994, for instance).

The light-emission principle of PDPs is basically the same as that of fluorescent lights. That is, in PDPs, voltage is applied to electrodes to generate glow discharges, ultraviolet light is emitted from Xe by the glow discharges, the ultraviolet light excites red, green and blue ultraviolet excitation phosphors, and the phosphors emit visible rays. However, PDPs are not as bright as fluorescent lights due to the low conversion ratios of discharge energy into ultraviolet light and of ultraviolet light into visible rays in the phosphors.

In this respect, "Applied Physics", Vol.51, No.3, 1982, page344–347 describes that a plasma display panel having a gas composition of He-Xe or Ne-Xe uses only about 2% of electric energy for emitting ultraviolet light and only about 0.2% of the electric energy is converted into visible rays (see "Optics Techniques Contact", Vol.34, No.1, 1996, page25, "FLAT PANEL DISPLAY 96'", Part 5-3, and "NHK Techniques Study", 31-1, 1979, page18, for instance).

Regarding this problem, various techniques have been studied to realize discharge panels, such as PDPS, of high panel brightness and low firing voltage by improving the light-emission efficiency.

There are also market demands for such discharge panels. For instance, in current 40–42 inch PDPs for TV sets of National Television System Committee (NTSC) standard, the number of cells is 640×480, cell pitch 0.43 mm×1.29 mm, and area of one cell about 0.55 $mm^2$. In this case, PDPs have the panel efficiency of 1.2 lm/w and the panel brightness of 400 $cd/m^2$ (see FLAT PANEL DISPLAY, 1997, part5-1, page198, for instance).

On the contrary, in 42-inch high-definition TVs that are recently in increasing demand, the number of cells is 1920×1125, cell pitch 0.15 mm×0.45 mm, and area of one cell 0.072 $mm^2$. The area of one cell of high-definition TVs is reduced to 1/7–1/8 of that under NTSC. Accordingly, when a PDP for a 42-inch high-definition TV is produced using a conventional cell construction, the panel efficiency and the panel brightness may be lowered respectively to 0.15–0.17 lm/w and to 50–60 $cd/m^2$.

The panel efficiency of a PDP for a 42-inch high-definition TV, therefore, needs to be improved ten times or more (5 lm/w or more) to acquire the same brightness as that of a current NTSC CRT (500 $cd/m^2$) (see FLAT PANEL DISPLAY, 1997, part5-1, page200, for instance).

Aside from the improvement in the panel brightness, the white balance needs to be adjusted by improving the color purity to realize a PDP of fine picture quality.

Various studies and inventions have been made to improve the light-emission efficiency and the color purity.

Japanese Patent Publication No. 5-51133, for instance, discloses a PDP that uses three-component mixture gas of argon (Ar)-neon (Ne)-xenon (Xe).

With the mixture gas including argon, the amount of visible rays generated by neon is reduced, so that the color purity is improved. However, the light-emission efficiency is not so improved.

Japanese Patent No. 2616538 discloses a method where three-component mixture gas of helium (He)-neon (Ne)-xenon (Xe) is used.

With this mixture gas, the light-emission efficiency is improved, in comparison with the case where two-component mixture gas of helium (He)-xenon (Xe) or neon (Ne)-xenon (Xe) is used. However, the light-emission efficiency is improved to about 1 lm/w at most in the case of the pixel level of NTSC. Therefore, a technique of further improving the light-emission efficiency is desired.

Regarding the stated problems, the object of the present invention is to provide a gas discharge panel, such as a PDP, where the panel brightness and the conversion efficiency of discharge energy into visible rays are improved and light of fine color purity is emitted.

DISCLOSURE OF THE INVENTION

To achieve the above object, the gas discharge panel of the present invention has the construction where the pressure of discharge gas is set in a range of 800 Torr to 4000 Torr, that is higher than a conventional gas pressure.

The reasons why the light-emission efficiency is improved with this construction are given below.

In a conventional PDP, the pressure of discharge gas is ordinarily set under 500 Torr. In this case, resonance lines (whose wavelengths are mainly 147 nm) constitute a large proportion of the ultraviolet light generated by discharge.

On the other hand, when the gas pressure is high as described above (that is, many atoms are charged into discharge spaces), the proportion of molecular lines (whose wavelengths are mainly 154 nm and 172 nm) increases. Here, while the resonance lines are associated with a self-absorption phenomenon, molecular lines are rarely associated with such an absorption phenomenon. Therefore, the amount of ultraviolet with which the phosphor layers are irradiated increases, resulting in the improvement in the panel brightness and the light-emission efficiency.

Also, when ordinary phosphors are irradiated with ultraviolet light whose wavelength is long, the conversion efficiency of ultraviolet light into visible rays in the phosphors tends to increase. As a result, the panel brightness and the light-emission efficiency are improved.

The gas in a gas discharge panel ordinarily consists of neon (Ne) or xenon (Xe). When the gas pressure is relatively low, visible rays are emitted from neon (Ne) and the color purity is deteriorated by the visible rays. However, when the gas pressure is high like the present invention, most of the visible rays emitted from neon (Ne) are absorbed by discharge and are not emitted to the outside. As a result, the color purity is improved, in comparison with a conventional PDP.

Also, the first glow discharge is caused in a conventional PDP. However, when the gas pressure is set in a high range of 800 Torr to 4000 Torr like the present invention, it is supposed that a filamentary glow discharge or the second glow discharge tends to be caused. Accordingly, the electron density in positive column regions increases and energy is intensively supplied to the positive column regions. As a result, the amount of ultraviolet light emission increases.

Furthermore, the gas pressure that exceeds the atmospheric pressure (760 Torr) prevents a PDP from containing impurities that exist in the atmosphere.

It should be noted here that respective gas pressure ranges, that is a range that is no less than 800 Torr and under 1000 Torr, a range that is no less than 1000 Torr and under 1400 Torr, a range that is no less than 1400 Torr and under 2000 Torr, and a range that is no less than 2000 Torr and no more than 4000 Torr, acquire the characteristics described in embodiments.

When a rare four-component gas mixture including helium, neon, xenon, and argon is used as discharge gas, instead of conventional neon-xenon or helium-xenon gas mixture, the panel brightness and the light-emission efficiency are improved even if the amount of mixed xenon is small. That is, a PDP whose firing voltage is low and light-emission efficiency is high is realized with the rare four-component gas mixture.

Here, to suppress the firing voltage, it is preferable that the proportion of xenon is set to 5% by volume or less, that of argon 0.5% by volume or less, and that of helium under 55% by volume.

Also, when the four-component mixture gas is charged in a high range of 800 Torr to 4000 Torr, in particular, the panel brightness and the light-emission efficiency are improved, with the firing voltage being suppressed.

Furthermore, when the gas pressure is high in a PDP having the construction where display electrodes oppose address electrodes, with discharge spaces existing between the display electrodes and the address electrodes, the voltage necessary to perform addressing tends to rise. However, when the display electrodes and the address electrodes are arranged on the surface of either of a front cover plate and a back plate, with a dielectric layer existing between the display electrodes and the address electrodes, addressing is performed with a relatively low voltage even if the gas pressure is high.

DESCRIPTION OF THE PREFERRED EMBODIMENTS

The following is a description of the preferred embodiments of the present invention.

Embodiment 1

Overview of Construction and Production Method of PDP

Figure 1:
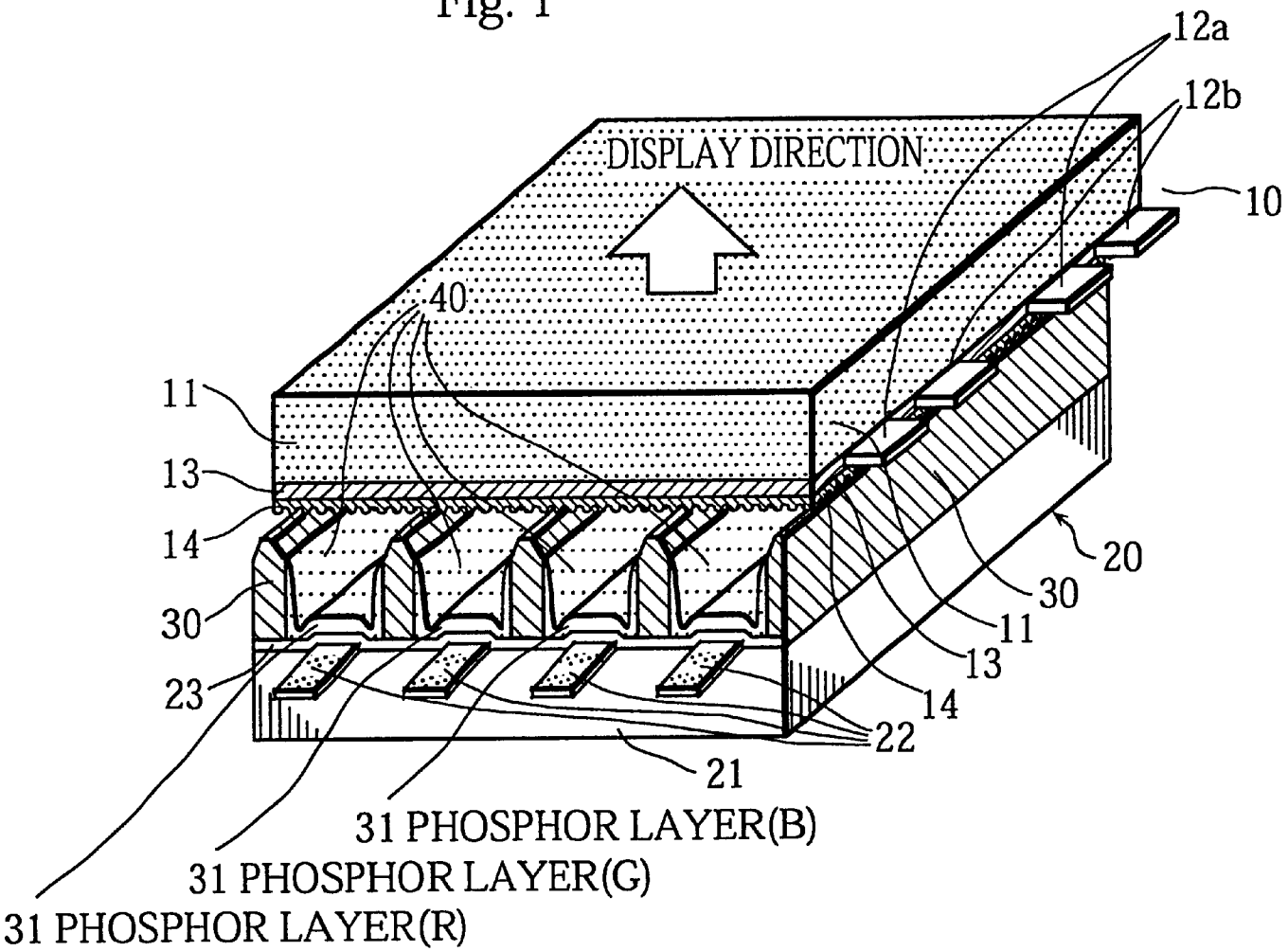
FIG. 1 is a simplified drawing of an AC PDP of Embodiment 1.

FIG. 1 is a perspective view of the AC PDP of the present embodiment.

The present PDP includes a front panel 10 which is made up of a front glass substrate 11 with display electrodes (discharge electrodes) 12*a* and 12*b*, a dielectric layer 13, and a protecting layer 14; and a back panel 20 which is made up of a back glass substrate 21 with address electrodes 22 and a dielectric layer 23, where the front panel 10 and the back panel 20 are placed in parallel so that the display electrodes 12*a* and 12*b* oppose the address electrodes 22 with a certain distance therebetween. The space between the front panel 10 and the back panel 20 is partitioned by stripe-shaped barrier ribs 30 to form discharge spaces 40. The discharge spaces are charged with discharge gas.

The back panel 20 is provided with phosphor layers 31, with the phosphor layers 31 being exposed to the discharge spaces 40. Red, green, and blue phosphor layers are repeatedly arranged in the order.

The display electrodes 12*a* and 12*b* are stripe-shaped silver electrodes and are arranged perpendicular to the barrier ribs 30. The address electrodes 22 are arranged parallel to the barrier ribs.

Cells that respectively emit red, green, or blue ray are formed at the intersections of the display electrodes 12*a* and 12*b* and the address electrodes 22.

The dielectric layer 13 is 20 $\mu$m in thickness and is made of lead glass or another glass material. The entire surface of the front glass substrate 11 with the display electrodes 12 thereon is covered with the dielectric layer 13.

The protecting layer 14 is a thin layer made of magnesium oxide (MgO) and covers the entire surface of the dielectric layer 13.

The barrier ribs 30 are arranged to protrude from the surface of the dielectric layer 23 of the back panel 20.

The present PDP is driven using a driving circuit as follows. Firstly, addressing discharge is performed by applying voltage between the display electrodes 12*a* and the address electrodes 22 of cells to be illuminated. Then, sustaining discharge is performed by applying a pulse voltage between the display electrodes 12*a* and the display electrodes 12*b* of the cells to emit ultraviolet light. Finally, the ultraviolet light is converted into visible rays by the phosphor layers 31 to illuminate the cells.

The production method of the present PDP having the stated construction is described below.

Production Method of Front Panel

The front panel 10 is made by: forming the display electrodes 12 on the front glass substrate 11; applying lead-based glass onto the display electrodes 12 and the front glass substrate 11; baking them to form the dielectric layer 13; then forming the protecting layer 14 on the surface of the dielectric layer 13; and forming minute projections on the surface of the protecting layer 14.

The display electrodes 12 are formed by applying a silver paste onto the front glass substrate 11 by screen printing and baking them.

The lead-based dielectric layer 13 is made of a mixture of 70% by weight of lead oxide (PbO), 15% by weight of boron oxide ($B_2O_3$), and 15% by weight of silicon oxide ($SiO_2$) by screen printing and baking them. More specifically, the dielectric layer 13 is formed by adding organic binder (made by dissolving 10% ethyl cellulose in $\alpha$-terpineol) to the mixture, applying the mixture onto the front glass substrate 11 with the display electrodes 12 by screen printing, and baking them for 10 minutes at 580° C. The formed dielectric layer 13 is 20 $\mu$m in thickness.

The protecting layer 14 is made of an alkaline earth oxide (in the present embodiment, magnesium oxide (MgO)) and is a film having a closely packed crystal structure of (100)-face or (110)-face orientation. The protecting layer 14 is processed to form projections on the surface of the protecting layer 14. In the present embodiment, an MgO protecting layer having (100)-face or (110)-face orientation is formed using CVD (Chemical Vapor Deposition) method, such as thermal CVD method and plasma CVD method. Then, the protecting layer is processed using a plasma etching method to form projections on the protecting layer surface. The methods of producing the protecting layer 14 and of forming projections on the protecting layer surface are described in detail later.

Production Method of Back Panel

The address electrodes 22 are formed by applying a silver paste onto the surface of the back glass substrate 21 by screen printing and baking them. Then, like the case of the front panel 10, the dielectric layer 23 made of lead-based glass is formed by screen printing and baking it. The barrier ribs 30 made of glass are attached onto the dielectric glass layer 23 with a predetermined pitch. The phosphor layers 31 are formed by inserting one of a red phosphor, a green phosphor, and a blue phosphor into each space between the barrier ribs 30. Although any phosphor ordinarily used for PDPs can be used for each color, the present embodiment uses the following phosphors:

red phosphor $(Y_xGd_{1-x})BO_3:Eu^{3+}$
green phosphor $BaAl_{12}O_{19}:Mn$
blue phosphor $BaMgAl_{14}O_{23}:Eu^{2+}$

Production of PDP by Bonding Together Front Panel 10 and Back Panel 20

The PDP of the present embodiment is made by bonding together the front panel 10 and the back panel 20, which are produced as described above, with sealing glass. At the same time, the air is exhausted from the discharge spaces 40 between the barrier ribs 30 to high vacuum ($8\times10^{-7}$ Torr). Then, discharge gas of a certain composition is charged into the discharge spaces 40 at a certain gas pressure.

Gas pressure and Composition of Discharge Gas

The pressure of discharge gas is raised to a range of 800–4000 Torr. This range is higher than the ordinary gas pressure range and exceeds the atmospheric pressure (760 Torr). By doing so, the panel brightness and the light-emission efficiency are improved.

It should be noted here that in the present embodiment, before the front panel and the back panel are bonded together and are baked, sealing glass is applied not only to the outer regions of the front panel and the back panel but onto the barrier ribs 30. By doing so, discharge gas can be charged at a high pressure (see Japanese Patent Application No. H9-344636 for further information). The PDP produced in this manner sufficiently withstand gas charging at a high gas pressure, such as 4000 Torr.

To improve light-emission efficiency and to suppress firing voltage, it is preferable to use a rare gas mixture including helium (He), neon (Ne), xenon (Xe), and argon (Ar) as discharge gas, instead of a conventional gas mixture of helium-xenon or neon-xenon.

Here, it is also preferable to set the proportion of xenon to 5% by volume or less, that of argon to 0.5% by volume or less, and that of helium under 55% by volume. The specific composition of discharge gas is, for instance, He(30%)-Ne(67.9%)-Xe(2%)-Ar(0.1%). Note that the symbol "%" in the gas composition expression refers to a unit of % by volume. This symbol is also used in the following description.

The settings of the composition and pressure of discharge gas are related to the light-emission efficiency and panel brightness of PDPs. When both settings are controlled, the light-emission efficiency and panel brightness are in particular improved, with firing voltage being suppressed. The settings of the composition and pressure of discharge gas are described in detail later.

When the gas pressure is set at a normal pressure (a conventional pressure of 500 Torr or less), the color purity tends to decrease because visible rays are emitted from neon (Ne) to the outside. On the contrary, when the gas pressure is raised to 800 Torr or more, even if visible rays are emitted from neon, the emitted visible rays are absorbed by plasma and are not emitted to the outside. As a result, the color purity is improved, in comparison with a case where the gas pressure is set at the normal pressure or less (500 Torr or less).

The gas pressure that exceeds the atmospheric pressure also prevents the discharge spaces 40 from containing impurities that exist in the atmosphere.

In the present embodiment, cell pitch is set to 0.2 mm or less and distance between the display electrodes 12 "d" is set to 0.1 mm or less, to make the cell size of the PDP conform to 40-inch high-definition TVs.

Note that the upper limit of gas pressure, that is 4000 Torr, is set so that firing voltage falls within a practical range.

Figure 2:
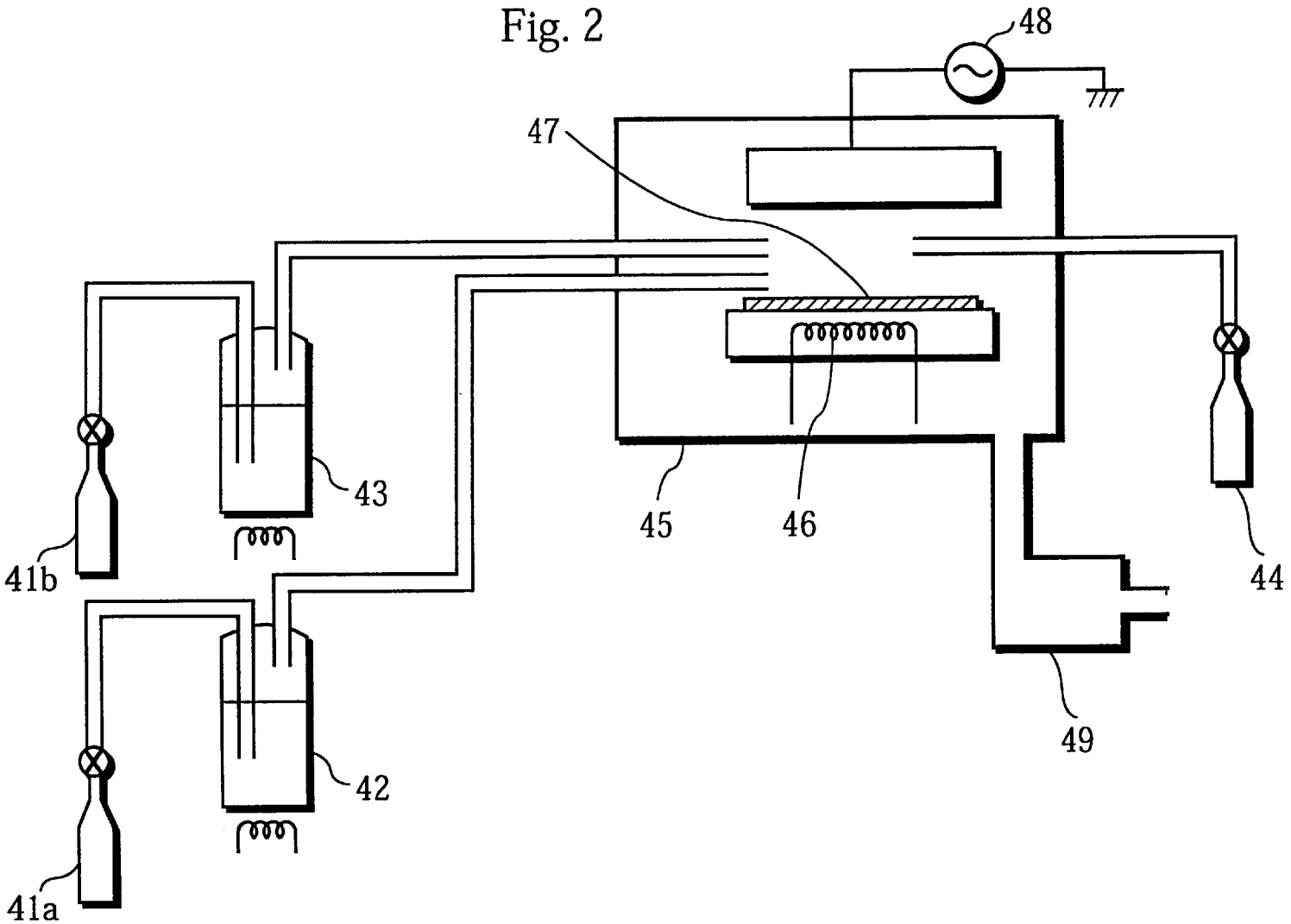
FIG. 2 is a simplified drawing of a CVD apparatus that is used for forming a protecting layer of the PDP.

Method of Producing MgO Protecting Layer and of Forming Projections on Surface of MgO Protecting Layer FIG. 2 is a simplified drawing of a CVD apparatus that is used to form the protecting layer 14.

The CVD apparatus can perform both of thermal CVD and plasma CVD. The main unit 45 includes a heating unit 46 for heating a glass substrate 47 (equivalent to the glass substrate 11 on which the display electrodes and the dielectric layer 13 are formed as shown in FIG. 1). The pressure inside the main unit 45 is reduced by a venting apparatus 49. Plasma is generated in the main unit 45 by a high-frequency power source 48.

Ar-gas cylinders 41*a* and 41*b* supply argon (Ar) gas, which is used as a carrier, to the main unit 45 respectively via bubblers 42 and 43.

The bubbler 42 stores a metal chelate used as the material for MgO, with the metal chelate being heated. The metal chelate is evaporated and is transferred to the main unit 45 while the argon gas is being blown on it from the Ar-gas cylinder 41*a*.

The bubbler 43 stores a cyclopentadienyl compound used as the material for MgO, with the cyclopentadienyl compound being heated. The cyclopentadienyl compound is evaporated and is transferred to the main unit 45 while the argon gas is being blown on it from the Ar-gas cylinder 41*b*.

The specific materials supplied from the bubblers 42 and 43 are, for instance, magnesium dipivaloyl methane ($Mg(C_{11}H_{19}O_2)_2$) magnesium acetylacetone ($Mg(C_5H_7O_2)_2$), cyclopentadienyl magnesium ($Mg(C_5H_5)_2$), and magnesium trifluoroacetylacetone ($Mg(C_5H_5F_3O_2)_2$).

An oxygen cylinder 44 supplies oxygen ($O_2$) used as a reaction gas to the main unit 45.

Procedure of Thermal CVD

The glass substrate 47 is put on the heating unit 46 so that the dielectric layer on the glass substrate 47 faces upward. Then the glass substrate 47 is heated at a certain temperature (350–400° C.), with the pressure inside the reaction container being reduced by the venting apparatus 49 to the certain pressure.

While the bubbler 42 or 43 heats the metal chelate or cyclopentadienyl compound of alkaline earth used as the material to a certain temperature, Ar gas is sent from the Ar-gas cylinder 41*a* or 41*b* and oxygen is sent from the oxygen cylinder 44.

The metal chelate or cyclopentadienyl compound reacts with oxygen in the main unit 45 and forms an MgO protecting layer on the surface of the dielectric layer formed on the glass substrate 47.

Procedure of Plasma CVD

The procedure is almost the same as that of the thermal CVD described above. However, the glass substrate 47 is heated by the heating unit 46 in a range of 250 to 300° C. At the same time, the pressure in the main unit is reduced to about 10 Torr by the venting apparatus 49. Under the circumstances, plasma is generated in the main unit 45 by driving the high-frequency power source 48 to apply high-frequency electric field of 13.56 MHz. As a result, an MgO protecting layer is formed on the surface of the dielectric layer formed on the glass substrate 47.

With the X-ray analysis of crystal structure of the MgO protecting layer formed with thermal CVD method or plasma CVD method, it is confirmed that the MgO protecting layer has (100)-face or (110)-face orientation. On the other hand, it is also confirmed with an X-ray analysis that an MgO protecting layer that is formed with a conventional vacuum deposition method (EB method) has (111)-face orientation.

It should be noted here that whether the MgO protecting layer formed with a CVD method has (100)-face orientation or (110)-face orientation is controlled by adjusting the amount of flow of oxygen used as a reaction gas.

The following is a description of the method of forming projections on the surface of a protecting layer using a plasma etching method.

Figure 3:
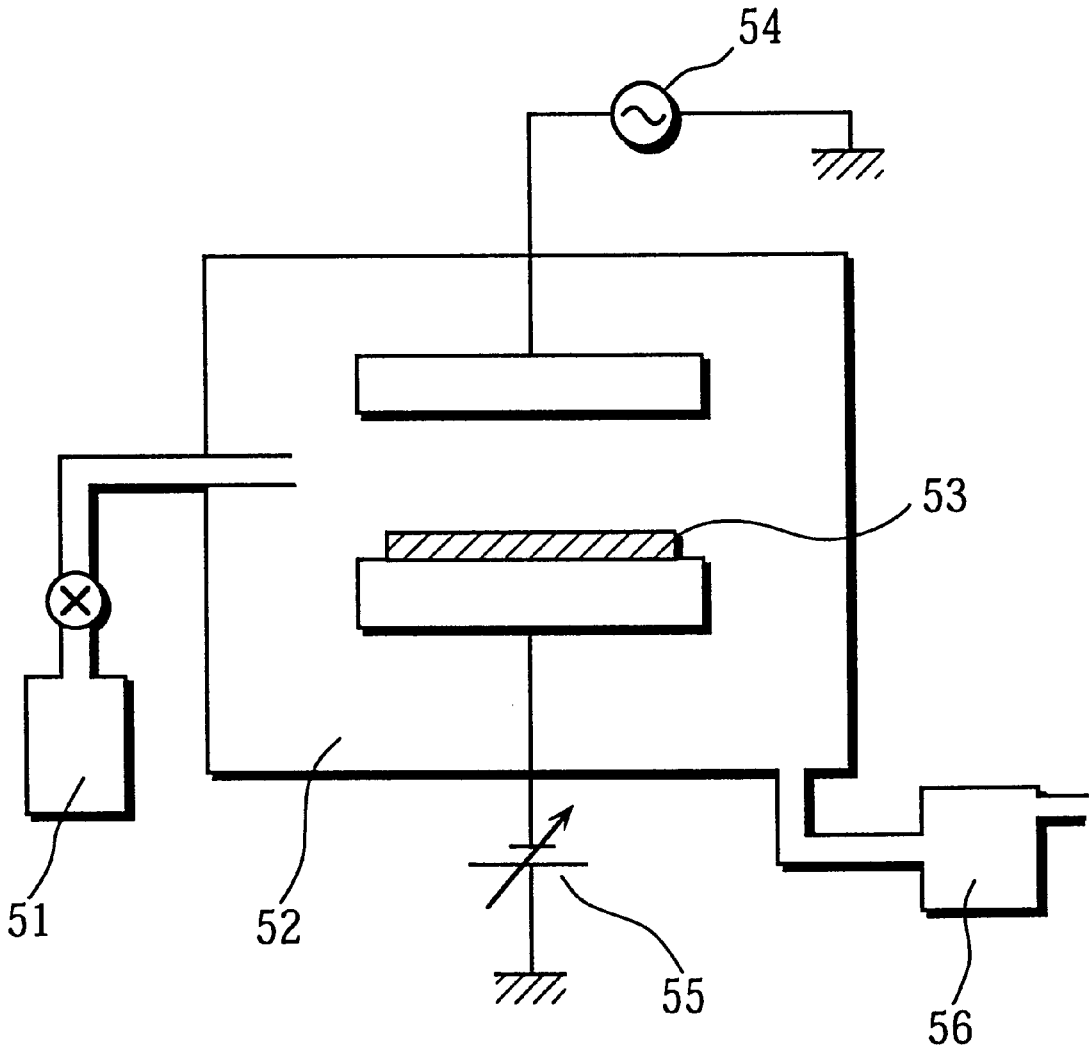
FIG. 3 is a simplified drawing of a plasma etching apparatus that is used for forming minute pyramid-shaped projections on an MgO protecting layer.

FIG. 3 is a simplified drawing of a plasma etching apparatus that is used to form minute pyramid-shaped projections on the surface of an MgO protecting layer.

The main unit 52 contains a substrate 53 on which a MgO protecting layer is formed (equivalent to the glass substrate 11 on which the display electrodes 12*a* and 12*b*, the dielectric layer 13, and the protecting layer 14 are formed as shown in FIG. 1). The pressure inside the main unit 52 is reduced by a venting apparatus 56. The plasma etching apparatus includes an Ar-gas cylinder 51 for supplying Ar gas, a high-frequency power source 54 for generating plasma in the main unit 52, and a bias power source 55 for irradiating ion generated by the plasma.

With the construction described above, the pressure inside the reaction container is reduced to a range of 0.001–0.1 Torr by the venting apparatus 56 and Ar gas is supplied from the Ar-gas cylinder.

Argon plasma is generated in the main unit 52 by driving the high-frequency power source 54 to apply high-frequency electric field of 13.56 MHz. Then, Ar ions are irradiated for ten minutes by driving the bias power source 55 to apply voltage (−200V) to the substrate 53. By doing so, the surface of the MgO protecting layer is sputtered.

As a result, pyramid-shaped projections are formed on the surface of the MgO protecting layer.

The sizes of the projections formed on the surface are controlled by adjusting sputtering time and the applied voltage. It may be appropriate for the surface roughness to be in a range of 30 nm–100 nm.

It is confirmed using a scanning electron microscope that pyramid-shaped projections are formed on the surface.

The protecting layer subjected to the stated processing has the following characteristics and effects (1) and (2).

(1) Because the crystal structure of the MgO protecting layer is (100)-face or (110)-face orientation, the emission coefficient of secondary electron ($\gamma$ value) is high. Accordingly, the MgO protecting layer contributes to the suppression of the driving voltage and the improvement in the panel brightness of PDPs.

(2) Because the pyramid-shaped projections are formed on the surface of the MgO protecting layer, the electric fields concentrate on the peaks of the projections during discharging. Therefore, many electrons are emitted from the peak. As a result, there is a high possibility that filamentary glow discharge or the second glow discharge is caused with stability.

When filamentary glow discharge or the second glow discharge is caused with stability, high-density plasma is caused in certain regions. Therefore, a large quantity of ultraviolet light (the wavelength is mainly 172 nm) is generated, in comparison with a case where the conventional first glow discharge is caused. As a result, the panel brightness is improved.

Various States of Glow Discharge

The filamentary glow discharge and the second glow discharge are described below.

"Discharge Handbook" (Electric Society, Jun. 1, 1989, page 138) describes the "filamentary glow discharge" and "second glow discharge" as follows.

"In the journal "J. Phys. D. Appl. Phys.", Vol.13, page1886 (1970), Kekez, Barrault, and Craggs describe that the discharge state is shifted from flashover, through Townsend discharge, the first glow discharge, and the second glow discharge, to arc discharge".

Figure 4:
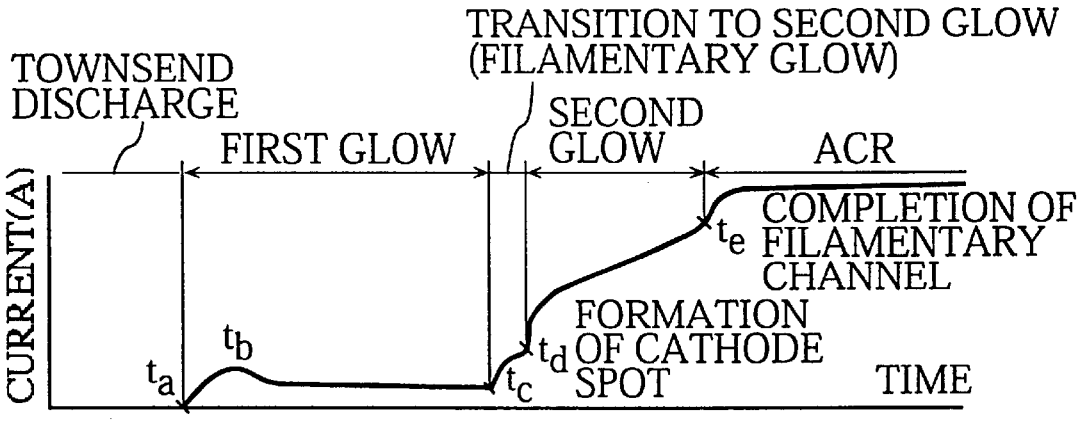
FIG. 4 is a graph showing the current waveforms of transition glow discharges and an acr discharge.

FIG. 4 is the graph that is cited from this journal and shows the current waveforms of respective transition glow discharges and the arc discharge.

The first glow discharge equates to an ordinary glow discharge and the second glow discharge equates to a discharge that is caused when discharge energy is on its way to be intensively supplied to positive column regions.

In FIG. 4, the first glow discharge is caused in the period between ta–tc when the current is stable at low level. The second glow discharge is caused in the period between td–te. The filamentary glow discharge is caused in the period between tc–td when the discharge state is shifted from the first glow discharge to the second glow discharge. The second glow discharge is shifted to the arc discharge after the point in time of te.

As can be seen from this drawing, the first glow discharge is caused with stability. However, while the filamentary glow discharge or the second glow discharge is caused, the current is unstable. Therefore, there is a high possibility that the discharge state is shifted to the arc discharge. Once the discharge state is shifted to the arc discharge, heat is produced and thermal ionization is caused in discharge gas. Accordingly, it is not preferable that the discharge state is shifted to the arc discharge.

Here, the first glow discharge is caused in conventional PDPs. However, it is supposed that the filamentary glow discharge or the second glow discharge is also caused with stability in the present embodiment. Therefore, it is supposed that the electron density can be increased in the positive column regions of discharge. As a result, energy is intensively supplied to the positive column regions, which increases the amount of ultraviolet light emission.

Relation between Gas Pressure and Light-Emission Efficiency of Discharge Gas

The following is a description of the reasons why the light-emission efficiency is improved by setting the pressure of discharge gas in a range of 800–4000 Torr, that is higher than the conventional gas pressure.

High gas pressure is supposed to be effective in causing the filamentary glow discharge or the second glow discharge. Therefore, the amount of ultraviolet light emission is increased.

Also, because the wavelength of ultraviolet light is shifted to long wavelengths (154 nm and 173 nm) due to a high gas pressure as described below, the light-emission efficiency is improved.

The ultraviolet light emitted in PDPs is roughly divided into resonance lines and molecular lines.

The pressure of discharge gas is conventionally set under 500 Torr. Therefore, Xe emits ultraviolet light mainly at 147 nm (resonance line of Xe molecule). However, by setting the gas pressure at 760 Torr or more, the ratio of long wavelength (173 nm, excitation wavelength by molecular beam of Xe molecules) increases. Also, molecular lines whose wavelengths are 154 nm and 173 nm increases to a ratio higher than that of resonance lines whose wavelengths are 147 nm.

Figure 5:
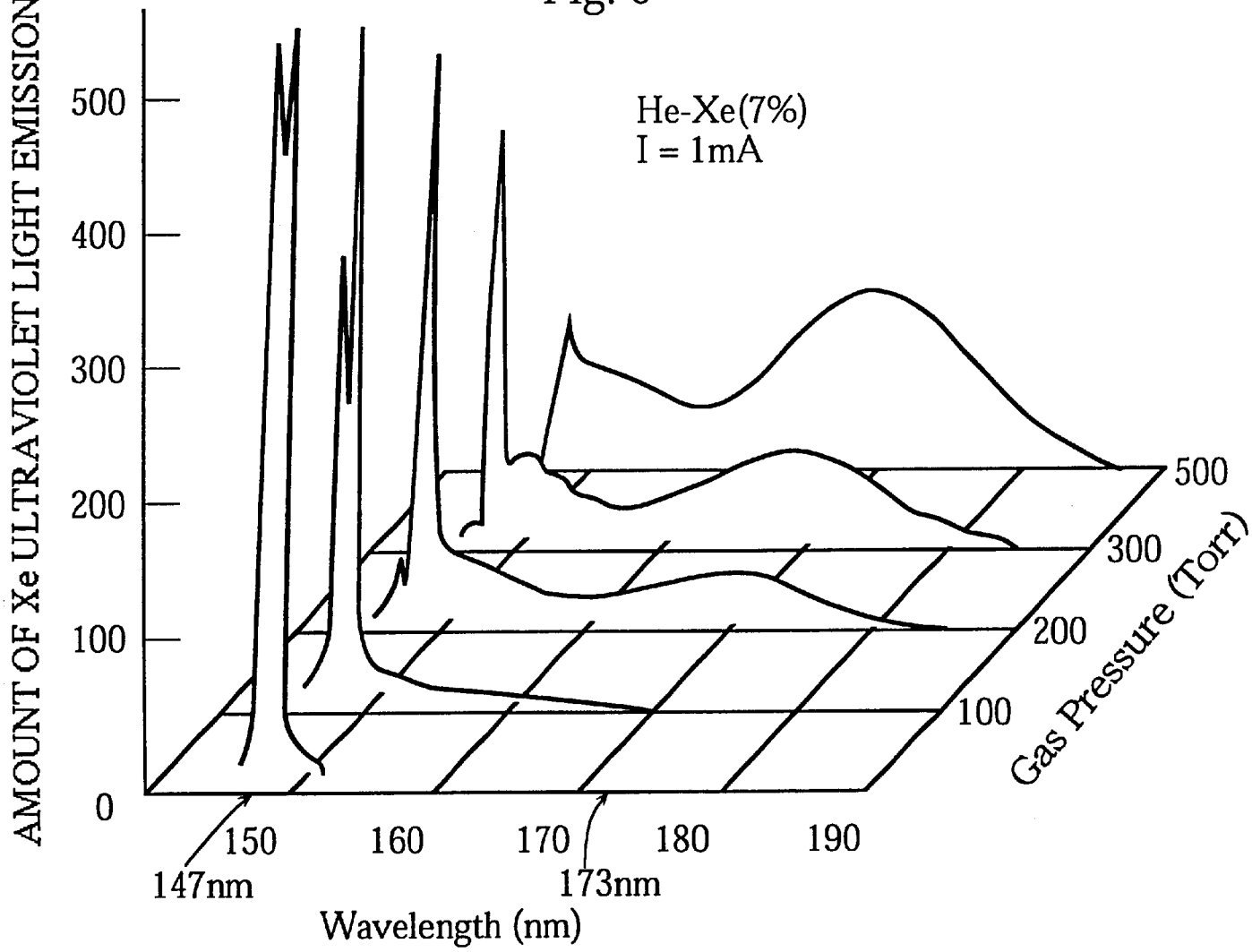
FIG. 5 is a graph showing how the relation between a ultraviolet light wavelength and the amount of ultraviolet light emission is changed as a gas pressure is changed.

FIG. 5 is a graph that is cited from "O Plus E, No.195, 1996, page98" and shows how the relation between the light wavelength and the amount of ultraviolet light emission is changed as the gas pressure is changed in a PDP using He-Xe discharge gas.

In this graph, the peak area for each wavelength, such as 147 nm (resonance line) and 173 nm (molecular line), represents the amount of ultraviolet light emission. Therefore, the relative amount of ultraviolet light emission for each wavelength can be known by comparing each peak area in this graph.

When the gas pressure is set to 100 Torr, the proportion of ultraviolet light emission at 147 nm (resonance line) becomes large. However, as the gas pressure increases, the proportion of ultraviolet light emission at 173 nm (molecular line) increases. When the gas pressure is set to 500 Torr, the proportion of ultraviolet light emission at 173 nm becomes larger than that at 147 nm (resonance line).

As described above, as the wavelength of ultraviolet becomes longer, (1) the amount of ultraviolet light emission increases and (2) the conversion efficiency of flourescent substances is improved. Each effect is described below.

(1) Increase in Ultraviolet Light Emission Amount

Figure 6:
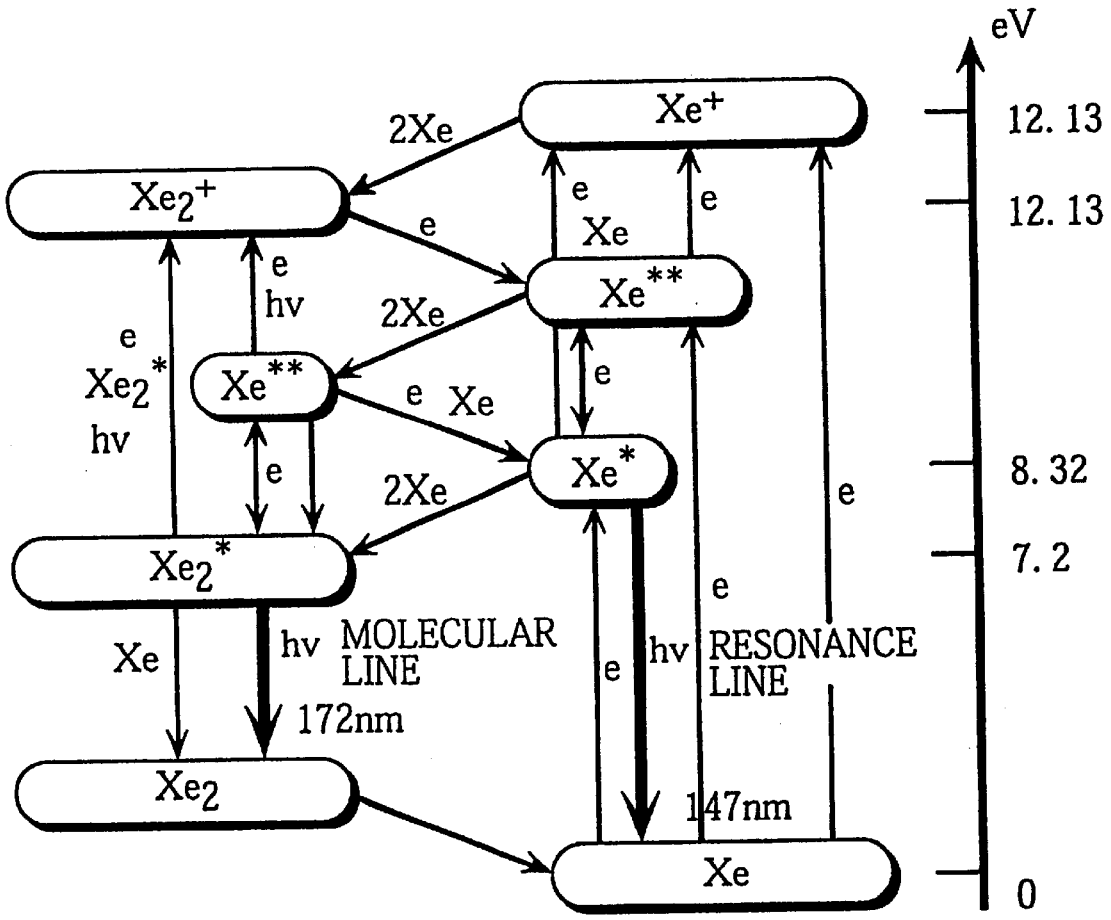
FIG. 6 shows energy levels and various reactive processes of Xe.

FIG. 6 shows energy levels and various reactive processes of Xe.

When electrons existing in atoms move from an energy level to another energy level, resonance lines are emitted. In the case of Xe, ultraviolet light is emitted mainly at 147 nm.

However, resonance lines are associated with a phenomenon called "induction absorption" where a part of emitted ultraviolet light is absorbed by Xe that is in a ground state. This phenomenon is ordinarily called "self-absorption".

On the other hand, molecular lines are rarely associated with such an absorption. This is because, as shown in FIG. 6, when two excited atoms approach each other so that the distance between them is less than a certain distance, ultraviolet light is emitted and the atoms return to a ground state.

To verify this theory qualitatively, simple theoretical calculation described below is carried out and the calculation result is compared with an experimental result.

The amount of generated resonance lines (V147) is calculated using $$V147=a*ne*n0$$

where ne=electron density and n0=atom density.

The amount of absorbed ultraviolet (Vabs) is calculated using $$Vabs=\exp(-b*n*l)$$

where b=absorption coefficient (ordinarily, about $10^{-6}$) and the length of plasma is set to 1.

On the other hand, because molecular lines are generated when Xe atoms approach each other, the amount of generated molecular lines (V172) is calculated using V172=

$C^*n^4+d^*n^3 \sim C^*n^4$. Molecular lines are rarely associated with the absorption phenomenon as described above. However, in consideration of geometry physical dispersion, V172 is calculated from $V172=C^*n^4-n^{2/3}$.

Accordingly, the total amount of ultraviolet light emission V is calculated using $$V=a^*ne^*n0-c^*\exp(-b^*n^*l)+C^*n^4-n^{2/3}$$

where a, b, and c are arbitrary constants.

Figure 7:
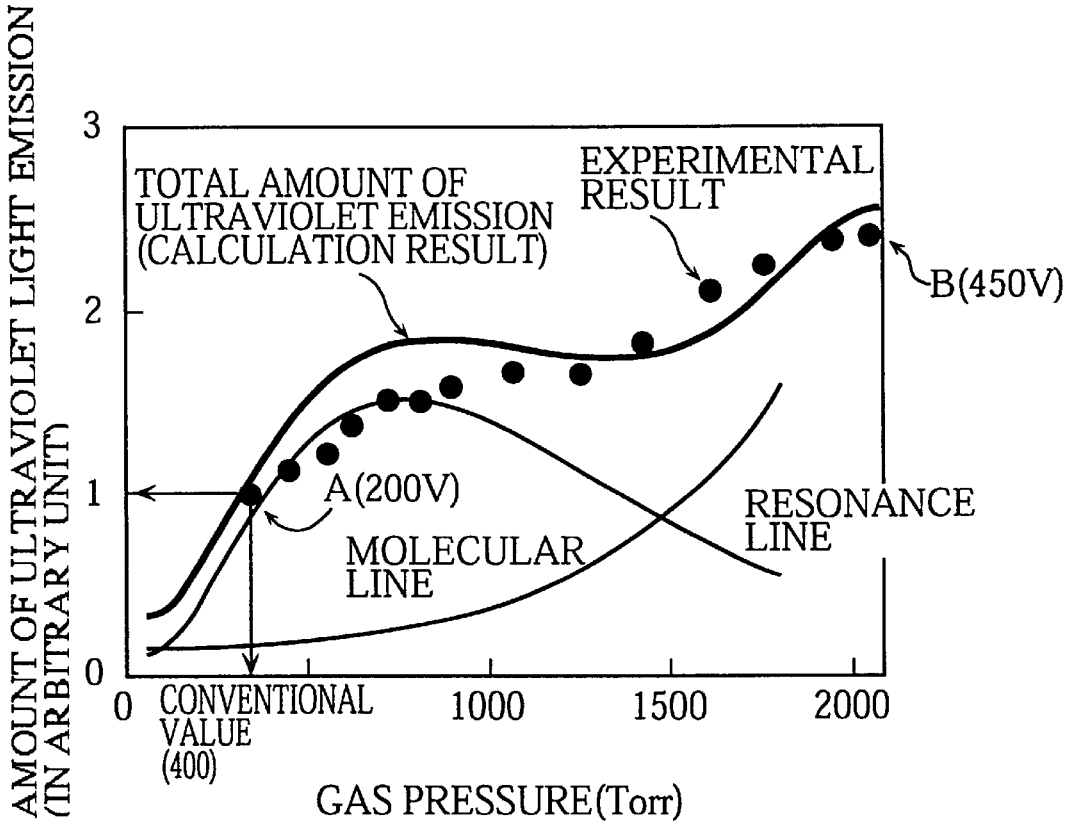
FIG. 7 is a graph showing the amount of resonance lines, the amount of molecular lines, and the total amount of ultraviolet light emission for respective discharge gas pressures.

FIG. 7 is a graph showing the amount of resonance lines, the amount of molecular lines, and the total amount of ultraviolet light emission for respective discharge gas pressures. In this graph, the horizontal axis is an arbitrary axis. However, it can be seen from this graph that gas pressure higher than a certain degree is required to adequately benefit from the effects of molecular lines.

The amount of ultraviolet light emission for respective gas pressures is examined according to a vacuum chamber experiment, with the composition of discharge gas being Ne(95%)-Xe(5%). The discharge gas having this composition is used for an ordinary PDP. As can be seen from the data marked "●". in FIG. 7, the experimental result demonstrates characteristics close to the theory described above.

(2) Improvement in Conversion Efficiency of Phosphors

Figure 8A:
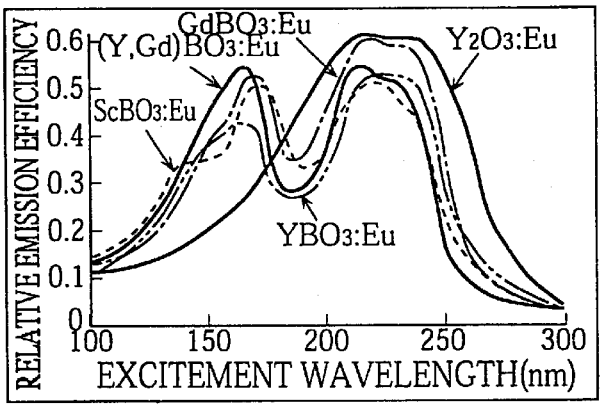
FIGS. 8A, 8B, and 8C show characteristics of relation between excitement wavelength and relative emission efficiency for the phosphor of each color.
Figure 8B:
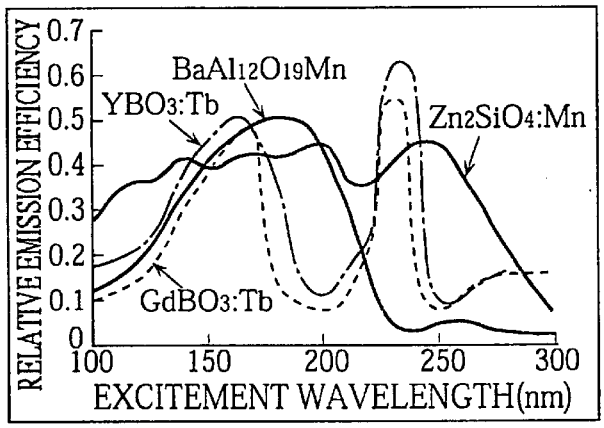
Figure 8C:
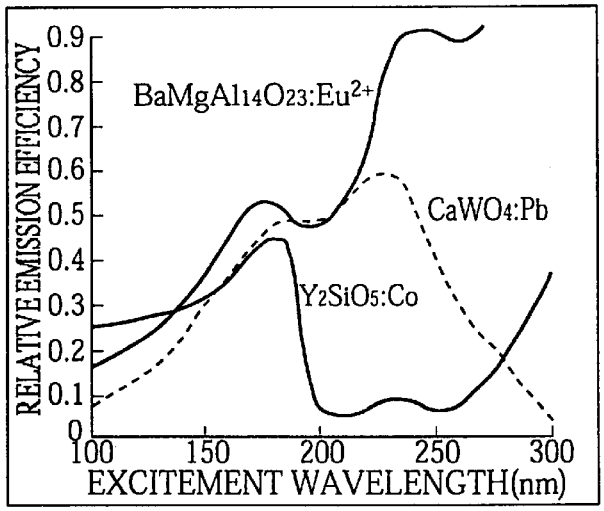

FIGS. 8A, 8B, and 8C that are cited from "O Plus E", No. 195, 1996, page99 show characteristics of relation between excitement wavelength and relative emission efficiency for the phosphor of each color.

As can be seen from these drawings, relative emission efficiency increases when the wavelength is shifted from 147 nm to 173 nm, regardless of the color of the phosphor.

Consequently, when the wavelength is shifted from 147 nm to 173 nm and the proportion of long wavelength is increased, the light-emission efficiency of respective phosphors tends to increase.

Relation among Gas Pressure, Light-Emission Efficiency, and Firing voltage

The following can be supposed from FIG. 7 that shows a state where the total amount of ultraviolet light emission is changing.

When the gas pressure is set in a range of 400–1000 Torr, the amount of ultraviolet light emission is increased as the gas pressure is increased. However, ultraviolet light reaches a point of saturation around 1000 Torr, so that the ultraviolet light emission amount is hardly increased from about 1000 Torr onward.

When the gas pressure is further increased to about 1400 Torr, the ultraviolet light emission amount restarts to increase. The ultraviolet light emission amount continuously increases until the gas pressure exceeds about 2000 Torr.

When the gas pressure is further increased to a certain level exceeding 2000 Torr, the ultraviolet light emission amount increases at a relatively mild pace. This may be because physical dispersion adversely affects the ultraviolet light emission amount.

It should be noted here that although not shown in FIG. 7, when the gas pressure is further increased to exceed the certain level, the ultraviolet light emission amount increases. This can be foreseen according to the theoretical equation described above.

According to the stated consideration, the preferable range of pressure of discharge gas (800–4000 Torr) is divided into four ranges: 800–1000 Torr (Range 1), 1000–1400 Torr (Range 2), 1400–2000 Torr (Range 3), and 2000–4000 Torr (Range 4).

It should be noted here that although the gas pressure that is set to 760 Torr or more theoretically produces the effect of increasing the ultraviolet light emission amount, the least gas pressure in the preferable range is set to 800 Torr. This is because conditions at facilities are taken into consideration. For instance, discharge gas is charged at a temperature higher than room temperature. Therefore, the least gas pressure is set from an industrial viewpoint.

The four ranges can be considered as follows.

When only the amount of ultraviolet light emission is taken into consideration, the most preferable range is surely Range 4, that is the most high pressure range.

On the other hand, the firing voltage of the PDP Vf can be expressed as a function of the product of the gas pressure P and the distance between electrodes d (Pd product). This rule is called "Paschen's law" (see Electronic Display Device, Ohmsha, 1984, pages113–114). As the gas pressure is increased, Pd product and the firing voltage tend to rise. Here, if the distance d is decreased, Pd product can be suppressed. However, a more sophisticated technique for insulating dielectrics is required as the distance d is decreased.

The degree of technical difficulty is therefore increased as the gas pressure is shifted from Range 1, through Ranges 2 and 3, to Range 4.

In a PDP corresponding to sign "A" in FIG. 7, for instance, the firing voltage is 200V. However, in a PDP corresponding to sign "B" in this drawing, the firing voltage is 450V.

Conventional techniques for insulating dielectrics and for making driving circuits resistant to pressure can therefore be applied to PDPs corresponding to Range 1 because the firing voltage is about 250V or less in a PDP corresponding to Range 1. On the contrary, PDPs corresponding to Ranges 3 and 4 requires sophisticated techniques to considerably decrease the distance d, which may lead to the increase in cost.

Composition of Discharge Gas, Light-Emission Efficiency, and Firing Voltage

As described above, when a rare gas mixture including helium (He), neon (Ne), xenon (Xe), and argon (Ar) is used as discharge gas, with the proportion of xenon being set to 5% by volume or less, that of argon to 0.5% by volume or less, and that of helium under 55% by volume, a PDP can be driven at a relatively low firing voltage (at 250V or less, or preferably at 220V or less) even if discharge gas is charged at high pressure.

That is, the firing voltage can be considerably suppressed using discharge gas having the composition described above, in comparison with the case where conventional discharge gas whose composition is Ne(95%)-Xe(5%) or He(95%)-Xe(5%) is used.

The relations among composition of discharge gas, light-emission efficiency, and firing voltage are described in detail below using experimental results.

Experiment 1/Preliminary Experiment Concerning Composition of Discharge Gas

Various PDPs that equate to the PDP of the present embodiment are produced using discharge gas of respective compositions shown in the table in FIG. 9, with Pd product being set to various values. Firing voltage is measured for each of the PDPs produced in this manner.

Pd product is set by setting the distance d to 20, 40, 60, or 120 $\mu$m and changing gas pressure P in a range of 100–2500 Torr.

Here, when Pd product is set to a small value, the distance d is mainly set to a relatively small value. When Pd product is set to a range of 1–4, for instance, the distance d is set to 20 μm and the pressure P is set in a range of 500–2000 Torr. On the other hand, when Pd product is set to a great value, the distance d is mainly set to a relatively great value (60 or 120 μm).

Figures 9A, 9B:
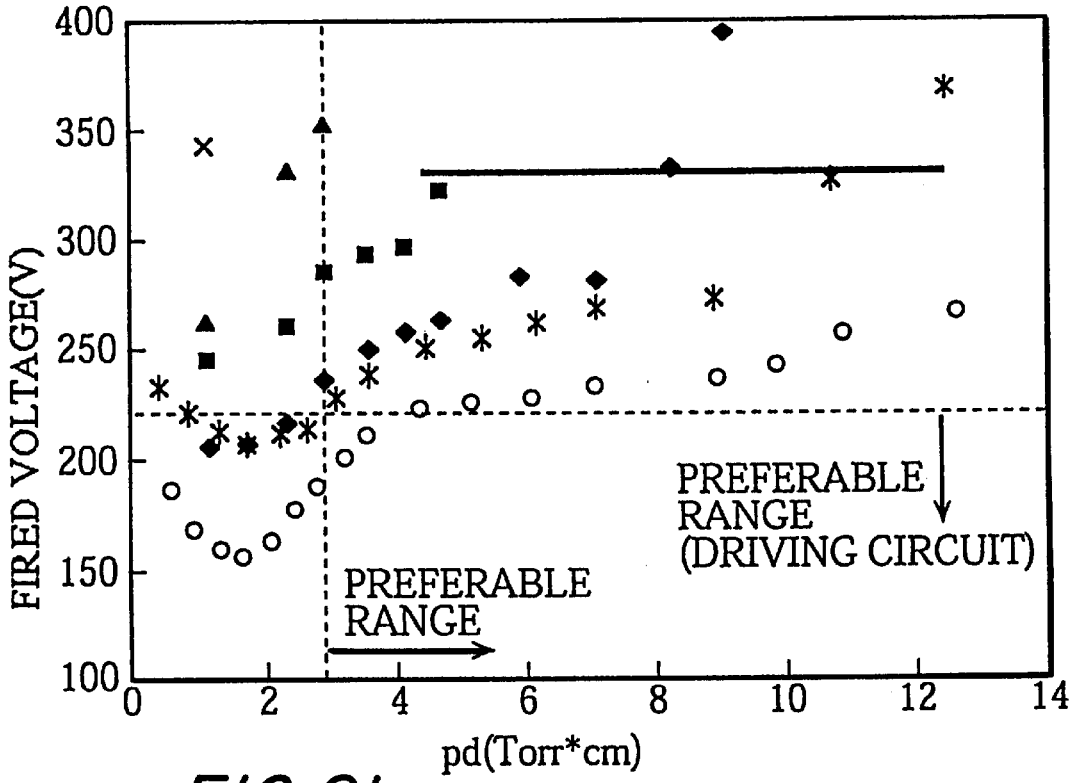
FIG. 9*a* shows a graph and FIG. 9*b* shows a table that give the results of Experiment 1.

The graph shown in FIG. 9*a* gives the experimental results and shows the relation between Pd product and the firing voltage.

The table shown in FIG. 9*b* gives the panel brightness that is measured (at firing voltage of about 250V) for a PDP having Pd product of about four (by setting gas pressure to 2000 Torr) for respective gas compositions.

Result and Consideration

As can be seen from the table shown in FIG. 9*b*, discharge gas of He-Xe or He-Ne-Xe achieves the panel brightness higher than discharge gas of Ne-Xe (in particular, discharge gas of He-Ne-Xe achieves high panel brightness). It can be assumed that He contributes to the improvement in the panel brightness by raising the electron temperature.

As can be seen from the graph shown in FIG. 9*a*, in the case of He-Xe (the data marked "▲"), firing voltage tends to be high, in comparison with the case of Ne-Xe (the data marked "◆"). Therefore, the firing voltage for He-Xe falls outside the preferable range (220V or less).

On the other hand, as can be seen from this graph, in the case of Ne-Xe discharge gas that includes 0.1% by volume of Ar (the data marked "O"), the firing voltage is suppressed to 220V or less because of the Penning effect, in comparison with the case of He-Xe, Ne-Xe, or He-Ne-Xe. Furthermore, in this case, preferable Pd product, that is three or more, is obtained.

However, in the case of Ne-Xe discharge gas that includes 0.5% by volume of Ar (the data marked "■"), the firing voltage is not so suppressed. Accordingly, it can be supposed that the addition of Ar in a relatively small amount (0.5% by volume or less) contributes to the suppression of the firing voltage.

It should be noted here that because it is technically difficult to set the distance d below 10 μm, the preferable range of Pd product is set to three or more in FIG. 9*a*. That is, it is preferable to set Pd product to a range of three or more in practical respects.

As described above, when He is added to Ne-Xe discharge gas, the firing voltage tends to be high although the light-emission efficiency is improved. However, when Ar is further added to the discharge gas, the firing voltage is suppressed, with the light-emission efficiency not being decreased. Here, it may be preferable that Ar is added in a relatively small amount.

It should be noted here that although in this embodiment, Pd product is set by changing the gas pressure P within a range of 100–2500 Torr, the same results in the graph shown in FIG. 9*a* can be achieved even if the gas pressure P is set in a range of 2500–4000 Torr.

Also, it is publicly known that when the proportion of Xe is in a low range (10% or less), the light-emission efficiency is roughly proportional to the amount of Xe. It is verified by experimental results that even if discharge gas used has any of the stated compositions, the light-emission efficiency is changed in response to change in the amount of Xe.

Experiment 2/Comparison of He-Ne-Xe-Ar Gas and Ne-Xe Gas

Various PDPs that equate to the PDP of the present embodiment are produced using discharge gas whose composition is He(30%)-Ne(67.9%)-Xe(2%)-Ar(0.1%) (hereinafter referred to as "discharge gas A") or discharge gas whose composition is Ne(95%)-Xe(5%) (hereinafter referred to as "discharge gas Z"), with Pd product being set to various values. Firing voltage is measured for each of the PDPs produced in this manner.

Pd product is set by setting the distance d to 20, 40, 60, or 120 μm and changing the gas pressure P in a range of 100–2500 Torr, as Experiment 1.

Figure 10:
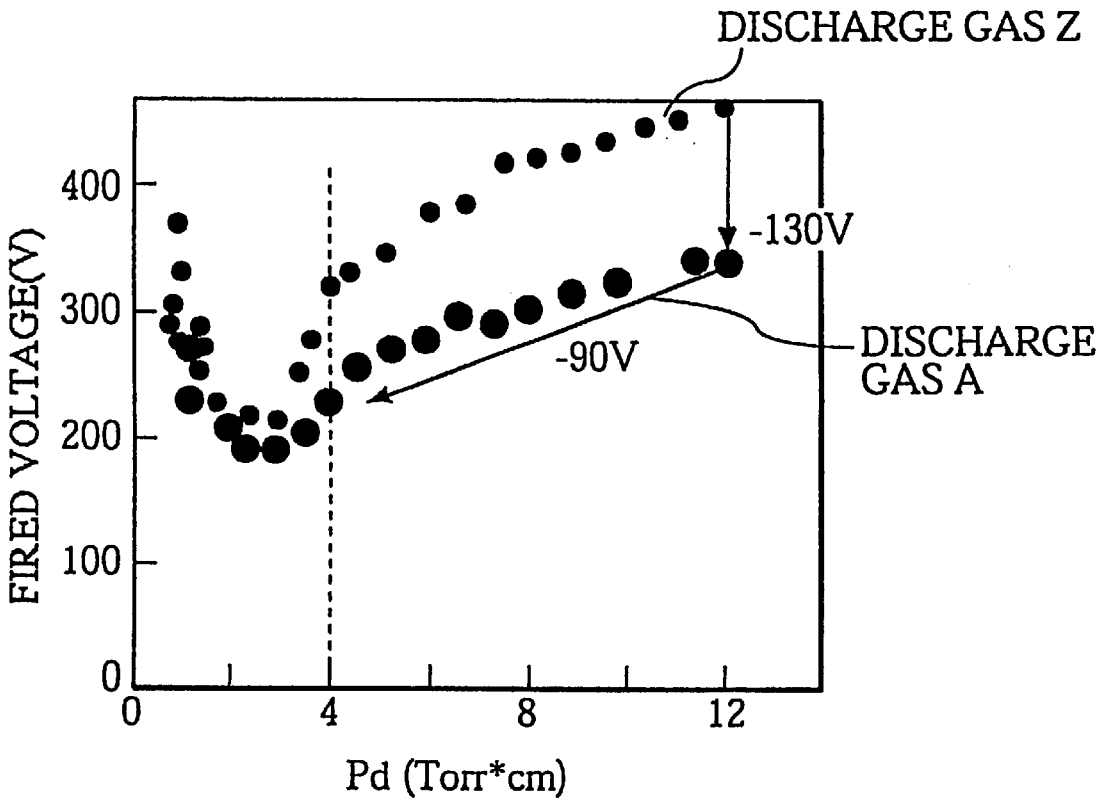
FIG. 10 is a graph showing the results of Experiment 2.

FIG. 10 is a graph that gives experimental results and shows the relation between Pd product and the firing voltage.

As can be seen from this graph, in the case of discharge gas Z, the firing voltage can be suppressed from 450V to 320V by 130V, by reducing Pd product from 12 to about four.

On the other hand, in the case of discharge gas A, even if Pd product is 12, the firing voltage is lower than the case of discharge gas Z by about 130V. Also, when Pd product is reduced from 12 to four, the firing voltage is further reduced by about 90V.

Accordingly, in the case of discharge gas A, even if the distance d is not so diminished under a high gas pressure, the firing voltage can be reduced to a practical level.

Also, with another experiment conducted to compare the light-emission efficiencies of discharge gas A and Z, it is confirmed that in the case of discharge gas A, even if voltage is reduced to a level much lower than that in the case of discharge gas Z, the panel brightness is not decreased. It is also confirmed that discharge gas A achieves the light-emission efficiency one-and-a-half times discharge gas Z.

The stated effects of discharge gas A are achieved by the combination of the improvement in the light-emission efficiency and the reduction in firing voltage. As described in the section of Experiment 1, the light-emission efficiency is improved by adding He to discharge gas and the firing voltage is reduced by adding Ar to discharge gas in a small amount.

As can be seen from the experimental results, the usage of He-Ne-Xe-Ar mixture gas as discharge gas has the effect of improving the light-emission efficiency and reducing the firing voltage. In this mixture gas, it is preferable that the proportion of Xe is set to 5% by volume or less and the proportion of Ar is set to 0.5% by volume or less.

In this experiment, Pd product is set by setting the gas pressure P in a range of 100–2500 Torr. However, even if the gas pressure P is set in a range of 2500–4000 Torr, results similar to those shown in the graph in FIG. 10 can be yielded.

Experiment 3/He-Ne-Xe Gas and He-Ne-Xe-Ar Gas

Various experimental PDPs that equate to the PDP of the present embodiment (the distance between electrodes d is set to 40 μm) are produced using discharge gas of various compositions, such as He(50%)-Ne(48%)-Xe(2%), He(50%)-Ne(48%)-Xe(2%)-Ar(0.1%), He(30%)-Ne(68%)-Xe(2%), and He(30%)-Ne(67.9%)-Xe(2%)-Ar(0.1%), with Pd product being set to various values. The panel brightness and firing voltage are measured for each of the experimental PDPs produced in this manner.

Figures 11A, 11B:
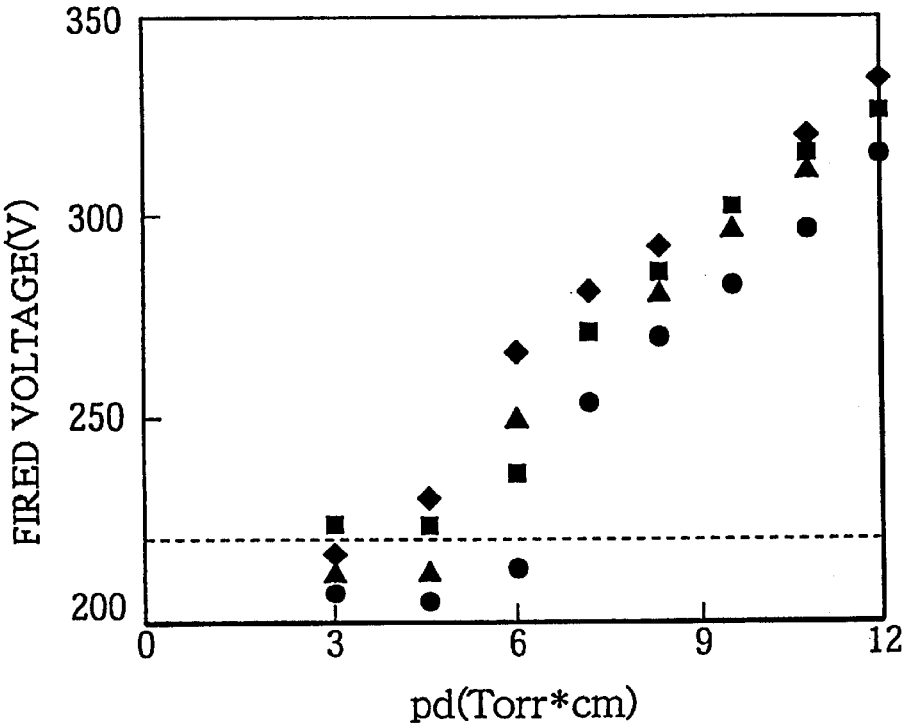
FIG. 11*a* shows a graph and FIG. 11*b* shows a table that give the results of Experiment 3.

The table shown in FIG. 11*b* shows the panel brightness of respective experimental PDPs. The panel brightness is measured by setting Pd product to about four, gas pressure to 2000 Torr, and firing voltage to 250V.

The measurement results of panel brightness shown in this table are considerably higher than those shown in the table in FIG. 9*b* that concerns He-Xe gas, Ne-Xe gas, and Ne-Xe-Ar gas. As can be seen by comparing these tables, the usage of He-Ne-Xe gas or He-Ne-Xe-Ar gas has the effect of improving panel brightness.

The graph in FIG. 11*a* gives measurement results of firing voltage and shows the relation between Pd product and the firing voltage for each gas composition.

As can be seen from the table and graph in FIG. 11*b* and FIG. 11*a* when Ar is added to He-Ne-Xe discharge gas in a small amount, the firing voltage is suppressed and the panel brightness is slightly improved, in comparison with the case where He-Ne-Xe discharge gas does not include Ar.

When discharge gas whose composition is He(30%)-Ne(67.9%)-Xe(2%)-Ar(0.1%) is used, in particular, relatively excellent panel brightness is obtained. When Pd product is set in a range of 3–6 (Torr*cm) for the discharge gas having this composition, the firing voltage falls within a practically preferable range (220V or less). To set Pd product in the range of 3–6, for instance, the distance d is set to 60 $\mu$m and the gas pressure is set to 1000 Torr.

When discharge gas has this composition and Pd product is about four, the firing voltage is suppressed to the minimum value. Therefore, it is preferable that Pd product is set to about four (for instance, by setting the distance d to 20 $\mu$m and the gas pressure to 2000 Torr).

In this experiment, the proportion of Xe is set to 2% in discharge gas for each composition. However, when the amount of Xe is set to another ratio no more than 10%, the effect similar to that shown in the graph in FIG. 11 can be achieved although the absolute value of the firing voltage changes.

Also, in this experiment, the proportion of He is set to 50% or less. With another experiment, it is confirmed that when the proportion of He is set to 55% by volume or more in He-Ne-Xe-Ar discharge gas, the firing voltage tends to considerably increase.

To suppress the firing voltage, therefore, it is preferable to set the proportion of He under 55% by volume.

Experiment 4/Proportion of Ar in He-Ne-Xe-Ar Gas

To determine the optimal proportion of argon in He-Ne-Xe-Ar gas, the firing voltage and light-emission efficiency are measured using discharge gas whose composition is He(30%)-Ne((68-X)%)-Xe(2%)-Ar(X%), where X=0.01, 0.05, 0.1, 0.5, or 1.

The light-emission efficiency is measured as follows. Firstly, discharge sustaining voltage Vm and current I are measured. The discharge sustaining voltage Vm is applied to the panel by the driving circuit and the current I passes during the application of the discharge sustaining voltage Vm. Then, the panel brightness L is measured using a luminance meter (the area where the panel brightness L is measured is set as S). Finally, the light-emission efficiency $\eta$ is calculated from Equation 1 given below.

$$\eta=\pi*S*L/Vm*I \quad \text{(Equation 1)}$$

Figure 12A:
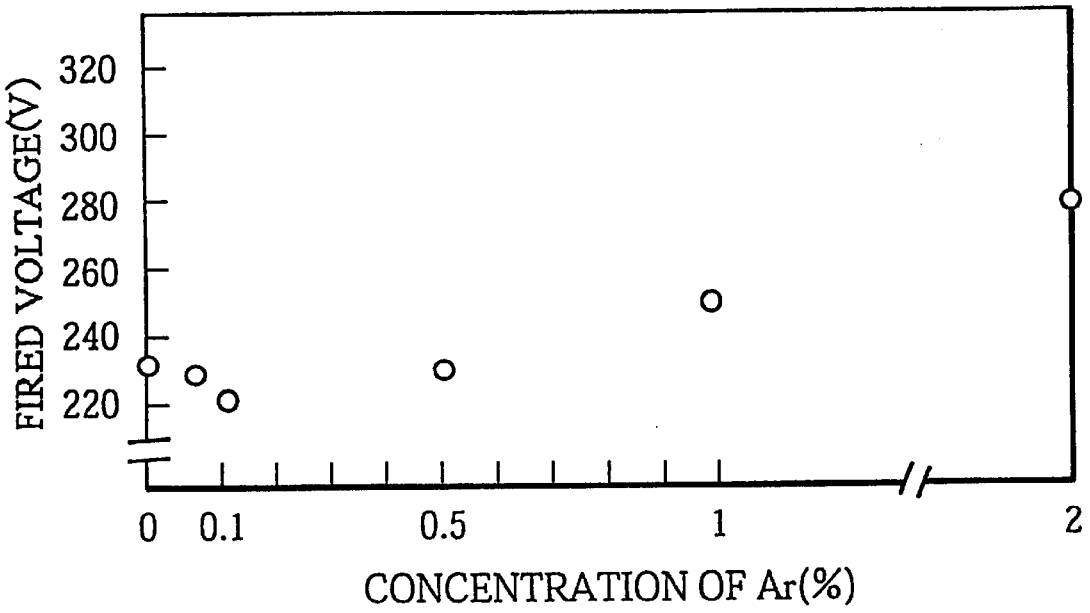
FIGS. 12*a* and 12*b* are graphs showing the results of Experiment 4.
Figure 12B:
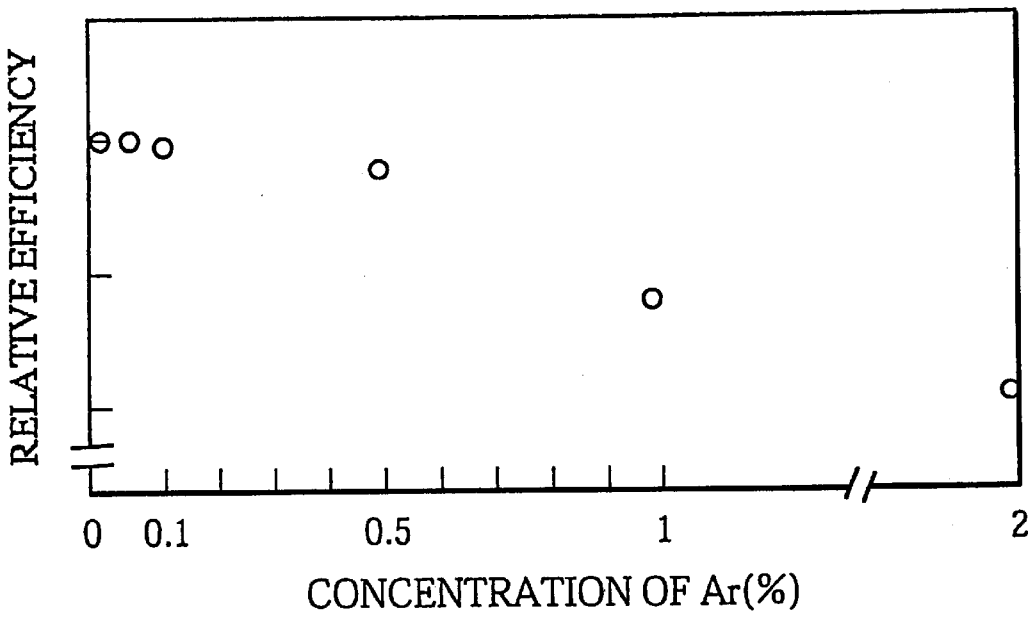

The graphs in FIG. 12*a* and FIG. 12*b* show an example of this measurement, where the gas pressure is set to 2000 Torr.

As can be seen from this drawing, the light-emission efficiency is almost constant when the proportion of Ar is 0.1% or less. However, when the proportion of Ar is increased in a range of 0.1%–0.5%, the light-emission efficiency is gradually reduced with increasing proportion of Ar. Furthermore, when the proportion of Ar exceeds 0.5%, the light-emission efficiency is plummeted with increasing proportion of Ar.

On the other hand, the firing voltage stands at the lowest value when the proportion of Ar is set to 0.1%. However, when the proportion of Ar is increased in a range of 0.1%–0.5%, the firing voltage gradually increases with increasing proportion of Ar. Furthermore, when the proportion of Ar exceeds 0.5%, the firing voltage rapidly increases with increasing proportion of Ar.

Consequently, it is preferable that the proportion of Ar added to discharge gas is set to 0.5% or less.

Although not shown in FIG. 12*a* and FIG. 12*b* even if the proportions of He and Xe are changed, the effect similar to that shown in FIG. 12*a* and FIG. 12*b* is achieved while the absolute values of the light-emission efficiency and firing voltage change. Also, even if the gas pressure is set in a normal range, the similar effect is achieved.

Embodiment 2

Figure 13:
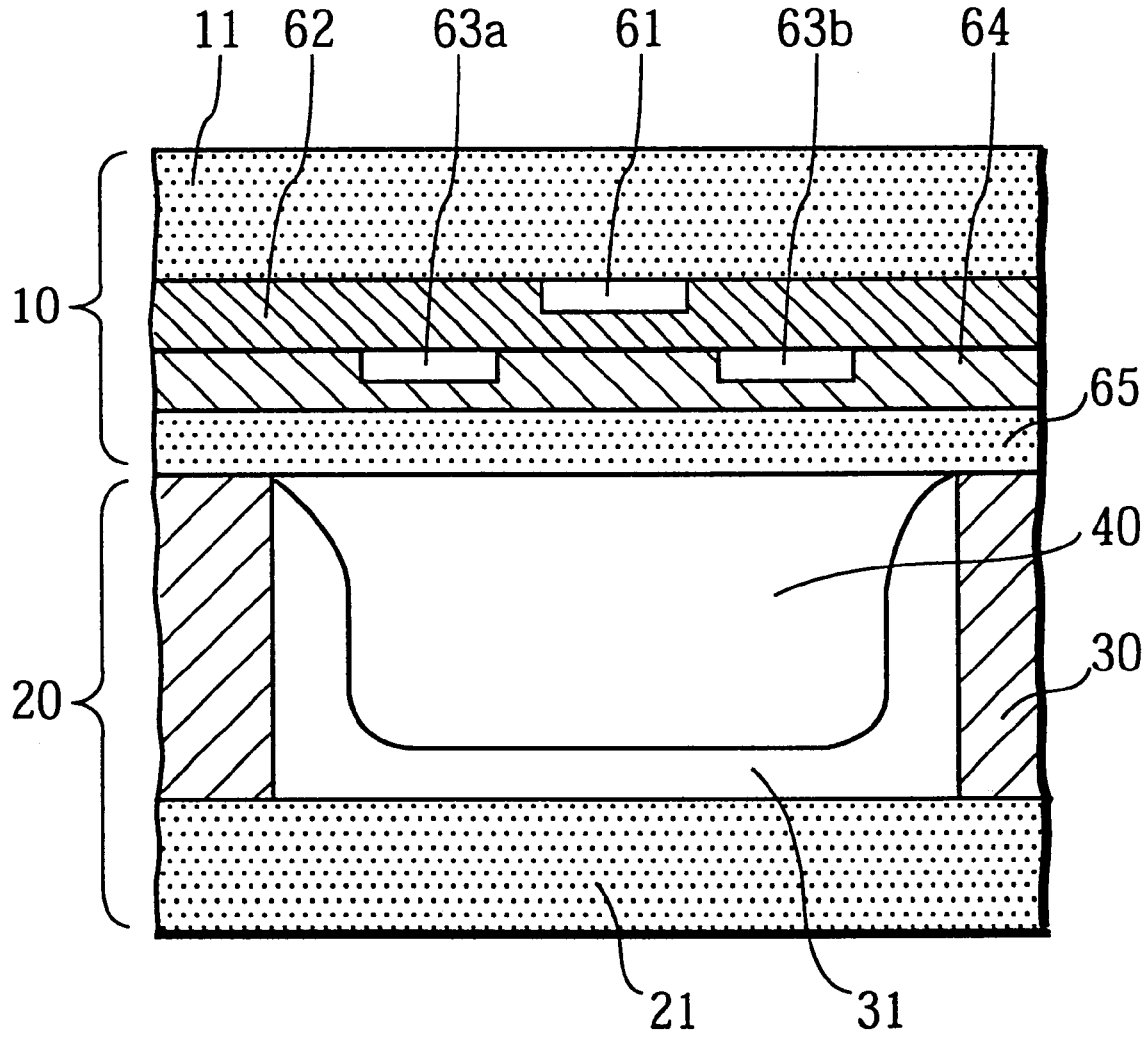
FIG. 13 is a simplified drawing of an AC PDP of Embodiment 2.

FIG. 13 shows the simplified sectional view of the AC PDP of the present embodiment.

The present PDP has the construction similar to the PDP of Embodiment 1. In Embodiment 1, the front panel is provided with the display electrodes and the back panel is provided with the address electrodes. However, in this embodiment, the front panel is provided with an address electrode 61 and display electrodes 63*a* and 63*b*, with the first dielectric layer 62 being inserted between the address electrode 61 and the display electrodes 63*a* and 63*b*.

It should be noted here that for ease of explanation, FIG. 13 shows the sectional view of a pair of display electrodes 63*a* and 63*b*. However, in a practical form, the pair of display electrodes 63*a* and 63*b* are arranged perpendicular to the address electrode 61 and barrier ribs 30, like the PDP shown in FIG. 1.

The PDP of the present embodiment is produced as follows.

The front panel 10 is made by: forming the address electrode 61 on the front glass substrate 11; applying lead-based glass onto the address electrode 61 and the front glass substrate 11; baking them to form the first dielectric layer 62; forming the display electrodes 63*a* and 63*b* on the surface of the first dielectric layer 62; then forming the second dielectric layer 64 from lead-based glass on the display electrodes 63*a* and 63*b* and the first dielectric layer 62; and forming a protecting layer 65 from MgO on the surface of the second dielectric layer 64.

The material and method used for forming the address electrode 61, the display electrodes 63*a* and 63*b*, the dielectric layers 62 and 63, and the protecting layer 65 are the same as those in Embodiment 1. Also, as Embodiment 1, it is preferable that the surface of the protecting layer 65 is processed using a plasma etching method to form pyramid-shaped projections.

The present embodiment achieves the same effect as Embodiment 1 by setting the composition and pressure of discharge gas in the same way as Embodiment 1.

As described above, in the present embodiment, the front panel is provided with the address electrode 61 and the display electrodes 63*a* and 63*b*, with the first dielectric layer 62 being inserted between the address electrode 61 and the display electrodes 63*a* and 63*b*. Accordingly, even if discharge gas is charged at a high gas pressure, addressing can be performed using low address voltage.

That is, when discharge spaces exist between address electrodes and display electrodes as Embodiment 1, Paschen's law is applied to address discharge. Here, address discharge may be performed with stability using low address voltage by decreasing the distance between the address electrodes and the display electrodes. However, it is technically difficult to decrease the electrode distance.

Therefore, to perform address discharge with stable, the address voltage needs to be raised as the pressure of discharge gas is increased.

On the other hand, in the PDP of the present embodiment, discharge spaces do not exist between the address electrode 61 and the display electrodes 63*a* and 63*b*. Consequently, even if discharge gas is charged at a high gas pressure, addressing is performed with stability using low address voltage.

Figure 14:
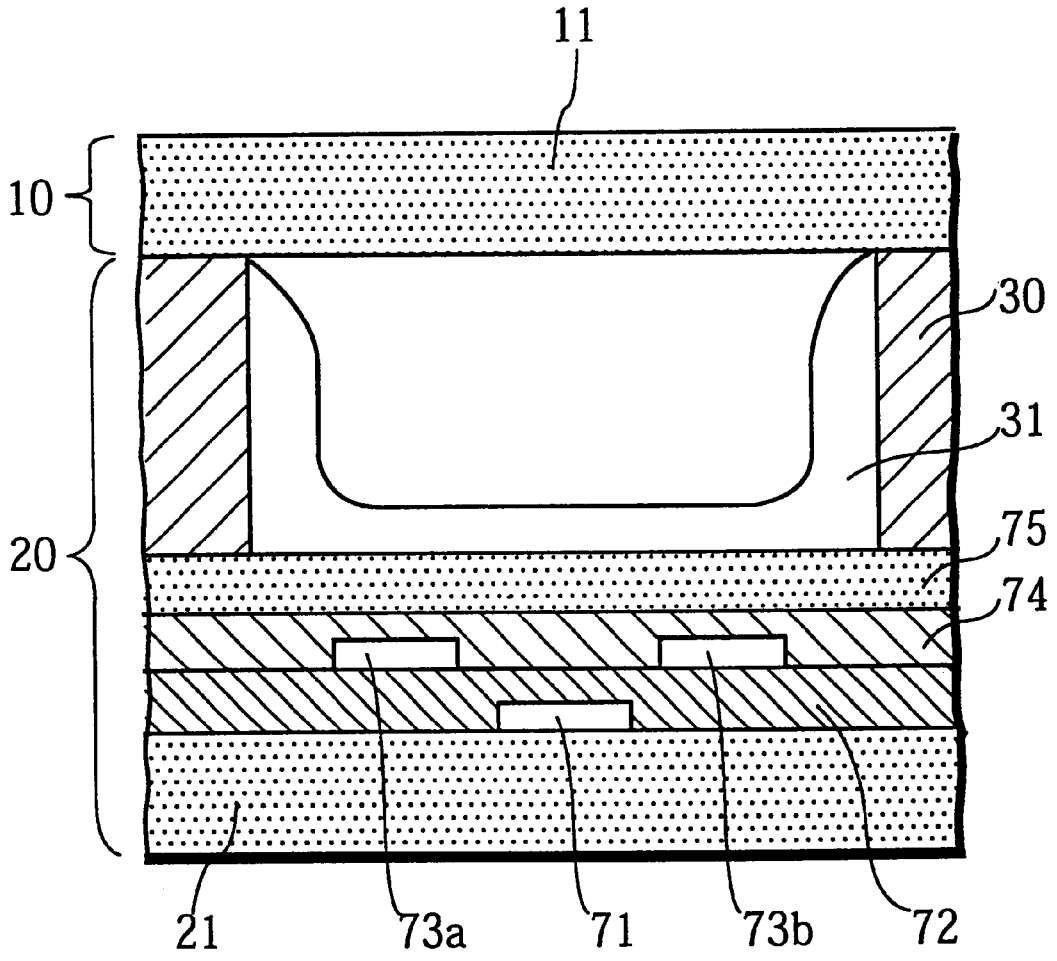
FIG. 14 is a simplified drawing of another AC PDP of Embodiment 2.

FIG. 14 shows the simplified sectional view of another PDP of the present embodiment.

In the PDP shown in FIG. 13, the front panel 10 is provided with the address electrode 61 and the display electrodes 63*a* and 63*b*, with the first dielectric layer 62 being inserted between the address electrode 61 and the display electrodes 63*a* and 63*b*. However, in the PDP shown in FIG. 14, the back panel 20 is provided with an address electrode 71 and display electrodes 73*a* and 73*b*, with the first dielectric layer 72 being inserted between the address electrode 71 and the display electrodes 73*a* and 73*b*.

The back panel 20 is made by: forming the address electrode 71 on the back glass substrate 21; forming the first dielectric layer 72 from lead-based glass on the address electrode 71 and the back glass substrate 21; forming the display electrodes 73*a* and 73*b* on the surface of the first dielectric layer 72; then forming the second dielectric layer 74 from lead-based glass on the display electrodes 73*a* and 73*b* and the first dielectric layer 72; and forming a protecting layer 75 from MgO on the surface of the second dielectric layer 74.

The PDP shown in FIG. 14 achieves the same effect as the PDP shown in FIG. 13.

In the present PDP, the back panel 20 is provided with the address electrode 71 and display electrodes 73*a* and 73*b*, with the first dielectric layer 72 being inserted between the address electrode 71 and the display electrodes 73*a* and 73*b*. Accordingly, visible rays generated in the discharge spaces illuminate cells of the PDP without being disturbed by electrodes. Therefore, in regard to the improvement in panel brightness, the present PDP is superior to the PDP shown in FIG. 13.

Experiment 5

In this experiment, the height of barrier ribs is set to 0.08 mm, the distance between the barrier ribs (cell pitch) 0.15 mm, and distance between electrodes "d" 0.05 mm, to make the cell size of the PDPs conform to displays for 42-inch high-definition TVs.

Each dielectric layer is formed by adding organic binder (made by dissolving 10% ethyl cellulose in α-terpineol) to a mixture of 70% by weight of lead oxide (PbO), 15% by weight of boron oxide ($B_2O_3$), and 15% by weight of silicon oxide ($SiO_2$), applying the mixture by screen printing, and baking it for 10 minutes at 580° C. The formed dielectric layer is 20 μm in thickness.

The protecting layer is formed with a plasma CVD method. Note that with the X-ray analysis of crystal structure of the formed MgO protecting layer, it is confirmed that the MgO protecting layer has (100)-face or (110)-face orientation.

The composition of discharge gas charged into discharge spaces is He(30%)-Ne(67.9%)-Xe(2%)-Ar(0.1%). Also, as shown in the "Gas pressure" column in Table 1, the gas pressure is set in a range of 500–200 Torr.

The panel brightness and stable address voltage are measured for each of PDP Example Nos. 1–6 that are produced in the stated manner.

To obtain the minimum address voltage necessary to display a stable image on a PDP, address voltage is changed, with the image state being observed. The minimum address voltage obtained in this manner is referred to as the stable address discharge in this specification.

The measurement results of the panel brightness and the stable address voltage are given in Table 1.

As can be seen by comparing the panel brightness of PDP Example Nos. 1–4, when the gas pressure is set to exceed the normal pressure, that is, to 1000 Torr or to 2000 Torr, the panel brightness increases.

As can be seen by comparing the stable address voltages of PDP Example Nos. 1–4, as the gas pressure is increased, the stable address voltage slightly increases. However, these stable address voltages are considerably lower than the stable address voltage of PDP Example No. 6.

Therefore, it is supposed that the construction of the PDP of Embodiment 2 has the effect of suppressing the address voltage even if the gas pressure is high. Also, as can be seen by comparing PDP Example Nos. 3 and 5, the panel brightness of PDP Example No. 5 is slightly higher than that of PDP Example No. 3.

TABLE 1

| EXAMPLE NUMBER | CHARGING GAS PRESSURE (Torr) | ADDRESS ELECTORDE POSITION | DISPLAY ELECTRODE POSITION | PANEL BRIGHTNESS (cd/cm$^2$) | STABLE ADDRESS VOLTAGE (V) |
|---|---|---|---|---|---|
| 1 | 500 | FRONT PANEL | FRONT PANEL | 490 | 50 |
| 2 | 760 | FRONT PANEL | FRONT PANEL | 520 | 50 |
| 3 | 1000 | FRONT PANEL | FRONT PANEL | 530 | 70 |
| 4 | 2000 | FRONT PANEL | FRONT PANEL | 580 | 70 |
| 5 | 1000 | BACK PANEL | BACK PANEL | 550 | 70 |
| 6 | 1000 | BACK PANEL | FRONT PANEL | 530 | 120 |

PDP Example Nos. 1–6 are produced in the same way as the PDPs in Embodiments 1 and 2. More specifically, PDP Example Nos. 1–4 are produced in the same way as the PDP shown in FIG. 13 of Embodiment 2, the PDP Example No. 5 is produced in the same way as the PDP shown in FIG. 14 of Embodiment 2, and the PDP Example No. 6 is produced in the same way as the PDP of Embodiment 1.

MODIFICATIONS

It should be noted here that the present invention is not limited to the PDPs of Embodiments 1 and 2 and may be applied to ordinary PDPs and gas discharge panels.

While the protecting layer is formed using a CVD method in Embodiments 1 and 2, for instance, a vacuum deposition method may be used. Also, any other method may be used to form the glass substrate, dielectric layer, and protecting layer, and any other material may be used for forming the phosphor layers. Furthermore, although MgO is used to form the protecting layer, Ba, Sr, or hydrocarbon may be added to MgO to form the protecting layer.

In Embodiments 1 and 2, only the back panel is provided with the phosphor layers. However, the front panel may also be provided with the phosphor layers. In this case, the panel brightness is further improved.

When particles of the phosphor materials used for forming the phosphor layers are coated with MgO protecting layers, the panel brightness and light-emission efficiency are expected to be further improved.

In Embodiments 1 and 2, the display electrodes are arranged parallel to each other on the surface of the front glass substrate or the back glass substrate. However, the display electrodes may be arranged on the surfaces of both of the front glass substrate and the back glass substrate so that the display electrodes arranged on the surface of the front glass substrate oppose the display electrodes arranged on the surface of the back glass substrate.

In Embodiments 1 and 2, the barrier ribs 30 are fixed on the back glass substrate 21 to form the back panel. However, the present invention may be applied to a PDP where the barrier ribs are attached to the front panel.

Also, in Embodiments 1 and 2, Ne-Xe discharge gas, He-Ne-Xe discharge gas, or He-Ne-Xe-Ar discharge gas is used. However, even if krypton-xenon discharge gas (Kr (90%)-Xe(10%), for instance) or krypton-neon-xenon discharge gas is charged in a range of 800–4000 Torr, the panel brightness and the light-emission efficiency are expected to be improved.

Furthermore, the present invention may be applied to gas discharge devices, where discharge spaces are formed by arranging electrodes and phosphor layers in a container and discharge gas is charged into the discharge spaces. The gas discharge devices emits light by performing discharge to generate ultraviolet light and by converting the ultraviolet light into visible rays using the phosphor layers.

The present invention may, for instance, be applied to fluorescent lights where phosphor layers are applied inside a pipe-shaped glass container and discharge gas is charged into the glass container. In this case, the present invention also has the effects of improving the brightness and light-emission efficiency and of suppressing the firing voltage. When the gas pressure is set in a range of 800–4000 Torr, the present invention achieves the outstanding effect.

INDUSTRIAL USE POSSIBILITY

As described above, the present invention improves the light-emission efficiency and panel brightness of a gas discharge panel by setting the pressure of discharge gas in a range of 800–4000 Torr (Ranges 1–4 described above), that is higher than a conventional range.

Also, the light-emission efficiency is improved, with the firing voltage being suppressed, using a rare gas mixture of helium, neon, xenon, and argon, instead of conventional discharge gas. Here, it is preferable that the proportion of Ar is set to 0.5% by volume or less and the proportion of He is set under 55% by volume.

Furthermore, with the construction where display electrodes and address electrodes are arranged on the surface of the front cover place or the back plate with a dielectric layer being inserted between the display electrodes and the address electrodes, addressing is performed with relatively low voltage even if discharge gas is charged at a high gas pressure.

The present invention has the effect of reducing power consumption of a gas discharge panel, and in particular has the effects of improving the panel brightness and reducing power consumption of a high-definition PDP.

Also, the present invention has the effects of improving the brightness and reducing power consumption of an ordinary gas discharge tube other than a gas discharge panel. The gas discharge tube is, for instance, a gas light-emission device, such as a fluorescent light.

What is claimed is:

1. A gas light-emission device for emitting light by discharging a discharge space using electrodes to produce ultraviolet light and converting the ultraviolet light into a visible ray using a phosphor layer, wherein the discharge space is formed in a sealed container and is charged with gas, and the electrodes and the phosphor layer are placed in the sealed container, wherein a pressure of the gas is in a range of 1400 Torr to 4000 Torr.

2. The gas light-emission device of claim 1, wherein the gas is a gas mixture including helium, neon, xenon, and argon.

3. The gas light-emission device of claim 2, wherein a proportion of the argon is 0.5% by volume or less, a proportion of the xenon is 5% by volume or less, and a proportion of the helium is under 55% by volume in the gas.

4. A gas light-emission device for emitting light by discharging in a discharge space using electrodes to produce ultraviolet light and converting the ultraviolet light into a visible ray using a phosphor layer, wherein the discharge space is formed in a sealed container and is charged with gas, and the electrodes and the phosphor layer are placed in the sealed container, wherein a pressure of the gas is no less than 1000 Torr and under 1400 Torr, and the gas is a gas mixture including helium, neon, xenon, and argon.

5. The gas light-emission device of claim 4, wherein a proportion of the argon is 0.5% by volume or less, a proportion of the xenon is 5% by volume or less, and a proportion of the helium is under 55% by volume in the gas.

6. A gas light-emission device for emitting light by discharging in a discharge space using electrodes to produce ultraviolet light and converting the ultraviolet light into a visible ray using a phosphor layer, wherein the discharge space is formed in a sealed container and is charged with gas, and the electrodes and the phosphor layer are placed in the sealed container, wherein a pressure of the gas is no less than 800 Torr and under 1,000 Torr, the gas is a gas mixture including helium, neon, xenon, and argon, and a proportion of the argon is 0.5% by volume or less, a proportion of the xenon is 5% by volume or less, and a proportion of the helium is under 55% by volume in the gas.

7. A gas discharge panel for emitting light by discharging in a discharge space using electrodes to produce ultraviolet light and converting the ultraviolet light into a visible ray using a phosphor layer, wherein the discharge space is formed between a pair of substrates that are placed so that main surfaces of the pair of substrates face each other, the discharge space being charged with gas, and either of the main surfaces is provided with the phosphor layer and at least one of the main surfaces is provided with the electrodes, wherein a pressure of the gas is in a range of 1,400 Torr to 4,000 Torr.

8. The gas discharge panel of claim 7, wherein the gas is a gas mixture including helium, neon, xenon, and argon.

9. The gas discharge panel of claim 8, wherein a proportion of the argon is 0.5% by volume or less, a proportion of the xenon is 5% by volume or less, and a proportion of the helium is under 55% by volume in the gas.

10. The gas discharge panel of claim 7, wherein when a voltage is applied to the electrodes, either of a filamentary glow discharge and a second glow discharge is performed in discharge space.

11. The gas discharge panel of claim 7, wherein the electrodes include display electrodes and address electrodes, the display electrodes being placed parallel to each other and the address electrodes being placed perpendicular to the display electrodes, wherein the display electrodes and the address electrodes are stacked on either of the main surfaces of the pair of substrates, a first dielectric layer existing between the display electrodes and the address electrodes.

12. The gas discharge panel of claim 11, wherein the pair of substrates includes a front cover substrate and a back substrate, wherein the display electrodes and the address electrodes are stacked on a main surface of the back substrate, the first dielectric layer existing between the display electrodes and the address electrodes.

13. The gas discharge panel of claim 11, wherein the address electrodes, the first dielectric layer, and the display electrodes are placed in the order on either of the main surfaces of the pair of substrates, and at least a part of each display electrode is covered with a second dielectric layer.

14. A gas discharge panel for emitting light by discharging in a discharge space using electrodes to produce ultraviolet light and converting the ultraviolet light into a visible ray using a phosphor layer, wherein the discharge space is formed between a pair of substrates that are placed so that main surfaces of the pair of substrates face each other, the discharge space being charged with gas, and either of the main surfaces is provided with the phosphor layer and at least one of the main surfaces is provided with the electrodes, wherein a pressure of the gas is no less than 1,000 Torr and under 1,400 Torr, and the gas is a gas mixture including helium, neon, xenon, and argon.

15. The gas discharge panel of claim 14, wherein a proportion of the argon is 0.5% by volume or less, a proportion of the xenon is 5% by volume or less, and a proportion of the helium is under 55% by volume in the gas.

16. The gas discharge panel of claim 14, wherein when a voltage is applied to the electrodes, either of a filamentary glow discharge and a second glow discharge is performed in the discharge space.

17. A gas discharge panel for emitting light by discharging in a discharge space using electrodes to produce ultraviolet light and converting the ultraviolet light into a visible ray using a phosphor layer, wherein the discharge space is formed between a pair of substrates that are placed so that main surfaces of the pair of substrates face either other, the discharge space being charged with gas, and either of the main surfaces is provided with the phosphor layer and at least one of the main surfaces is provided with the electrodes, wherein a pressure of the gas is no less than 800 Torr and under 1,000 Torr, the gas is a gas mixture including helium, neon, xenon, and argon, and a proportion of the argon is 0.5% by volume or less, a proportion of the xenon is 5% by volume or less, and a proportion of the helium is under 55% by volume in the gas.

18. The gas discharge panel of claim 17, wherein when a voltage is applied to the electrodes, either of a filamentary glow discharge and a second glow discharge is performed in the discharge space.

19. A display apparatus comprising a discharge panel and a driving circuit, wherein the discharge panel emits light by discharging in a discharge space using electrodes to produce ultraviolet light and converting the ultraviolet light into a visible ray using a phosphor layer, the discharge space being formed between a pair of substrates that are placed so that main surfaces of the pair of substrates face each other, the discharge space being charged with gas, and either of the main surfaces being provided with the phosphor layer and at least one of the main surfaces being provided with the electrodes, and the driving circuit drives the discharge panel by applying a voltage to the electrodes, wherein a pressure of the gas is in a range of 1,400 Torr to 4,000 Torr.

20. The display apparatus of claim 19, wherein the gas is a gas mixture including helium, neon, xenon, and argon.

21. The display apparatus of claim 20, wherein a proportion of the argon is 0.5% by volume or less, a proportion of the xenon is 5% by volume or less, and a proportion of the helium is under 55% by volume in the gas.

22. A display apparatus comprising a discharge panel and a driving circuit, wherein the discharge panel emits light by discharging in a discharge space using electrodes to produce ultraviolet light and converting the ultraviolet light into a visible ray using a phosphor layer, the discharge space being formed between a pair of substrates that are placed so that main surfaces of the pair of substrates face either other, the discharge space being charged with gas, and either of the main surfaces being provided with the phosphor layer and at least one of the main surfaces being provided with the electrodes, and the driving circuit drives the discharge panel by applying a voltage to the electrodes, wherein a pressure of the gas is no less than 1,000 Torr and under 1,400 Torr, and the gas is a gas mixture including helium, neon, xenon, and argon.

23. The display apparatus of claim 22, wherein a proportion of the argon is 0.5% by volume or less, a proportion of the xenon is 5% by volume or less, and a proportion of the helium is under 55% by volume in the gas.

24. A display apparatus comprising a discharge panel and a driving circuit, wherein the discharge panel emits light by discharging in a discharge space using electrodes to produce ultraviolet light and converting the ultraviolet light into a visible ray using a phosphor layer, the discharge space being formed between a pair of substrates that are placed so that main surfaces of the pair of substrates face either other, the discharge space being charged with gas, and either of the main surfaces being provided with the phosphor layer and at least one of the main surfaces being provided with the electrodes, and the driving circuit drives the discharge panel by applying a voltage to the electrodes, wherein a pressure of the gas is no less than 800 Torr and under 1,000 Torr, the gas is a gas mixture including helium, neon, xenon, and argon, and a proportion of the argon is 0.5% by volume or less, a proportion of the xenon is 5% by volume or less, and a proportion of the helium is under 55% by volume in the gas.

25. A thin large screen color plasma display panel with a low driving voltage and a high light emission efficiency comprising:

a front cover plate for emitting a display image;

a back plate;

a series of partition walls extending between the front cover plate and the back plate to provide a series of cells with discharge spaces;

a series of address electrodes mounted on one of the front cover plate and back plate to provide an electrical charge to respective discharge spaces;

a series of discharge electrodes mounted on one of the front cover plates and back plate to operatively interact with the respective discharge spaces;

phosphor layers to provide a multi-color display are provided within the series of discharge spaces;

a drive circuit for applying a firing address voltage between selected address electrodes and selected discharge electrodes of 250 volts or less; and a gas mixture of helium, neon, xenon and 0.5% by volume or less of argon is charged within the discharge space at a pressure above one atmosphere of pressure whereby a panel brightness of greater than 500 cd/cm$^2$ is provided.

26. The display panel of claim 25 further including a dielectric layer within the discharge spaces having a plurality of pyramid-shaped projections to assist in providing an electric field concentration adjacent the peaks of the pyramids during discharging.

27. The display panel of claim 25 wherein the cell pitch is set to 0.2 mm or less.

28. The display panel of claim 25 wherein the cell pitch is set to 0.15 mm.

29. The display panel of claim 25 wherein the firing address voltage is 120 volts or less.

30. The display panel of claim 29 wherein the pressure of the discharge space is 2000 Torr or greater.

31. The display panel of claim 30 wherein the volume of argon is substantially 0.1%.

32. The display panel of claim 29 wherein the back plate is mounted with the address electrodes and discharge electrodes.

33. The display panel of claim 25 wherein the front cover plate is mounted with the address electrodes and discharge electrodes.

34. The display panel of claim 25 wherein the gas mixture is 55% by volume or less of helium.

35. The display panel of claim 34 wherein the pressure of the gas mixture is in a range of 1400 Torr to 4000 Torr.

36. The display panel of claim 34 wherein the gas mixture is 5% by volume or less of xenon.

37. The display panel of claim 36 wherein the gas mixture is in a range of 800 Torr to 1000 Torr.

38. The display panel of claim 37 wherein the volume of argon is substantially 0.1%.

39. A thin large screen color plasma display panel with a low driving voltage and a high light emission efficiency comprising:

a front cover plate for emitting a display image;

a back plate;

a series of partition walls extending between the front cover plate and the back plate to provide a series of cells with discharge spaces;

a series of address electrodes mounted on one of the front cover plate and back plate to provide an electrical charge to respective discharge spaces;

a series of discharge electrodes mounted on one of the front cover plates and back plate to operatively interact with the respective discharge spaces;

phosphor layers to provide a multi-color display are provided within the series of discharge spaces;

a drive circuit for applying a firing address voltage between selected address electrodes and selected discharge electrodes;

a gas mixture of helium, neon, xenon and 0.5% by volume or less of argon is charged within the discharge space at a pressure above one atmosphere of pressure whereby a panel brightness of greater than 500 cd/cm$^2$ is provided.

40. The display panel of claim 39 further including a dielectric layer within the discharge spaces having a plurality of pointed peak projections extending into each discharge space to assist in providing an electric field concentration adjacent the pointed peak projections during discharging.

41. The display panel of claim 39 wherein the cell pitch is set to 0.15 mm.

42. The display panel of claim 39 wherein the firing address voltage is 120 volts or less.

43. The display panel of claim 42 wherein the volume of xenon is 5% by volume or less.

44. The display panel of claim 39 wherein the pressure of the discharge space is 2000 Torr or greater.

45. The display panel of claim 44 wherein the volume of argon is substantially 0.1%.

* * * * *